US008449084B2

(12) United States Patent
Miyazawa et al.

(10) Patent No.: US 8,449,084 B2
(45) Date of Patent: May 28, 2013

(54) LIQUID EJECTION HEAD AND LIQUID EJECTION APPARATUS

(75) Inventors: Hiromu Miyazawa, Azumino (JP); Hiroshi Ito, Suwa (JP); Jiro Kato, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 144 days.

(21) Appl. No.: 13/004,823

(22) Filed: Jan. 11, 2011

(65) Prior Publication Data

US 2011/0169896 A1 Jul. 14, 2011

(30) Foreign Application Priority Data

Jan. 13, 2010 (JP) ..... 2010-004641

(51) Int. Cl.
*B41J 2/045* (2006.01)

(52) U.S. Cl.
USPC ..... 347/68

(58) Field of Classification Search
None
See application file for complete search history.

(56) References Cited

U.S. PATENT DOCUMENTS

| | | | | |
|---|---|---|---|---|
| 6,309,055 | B1 * | 10/2001 | Sakai et al. | 347/70 |
| 7,453,188 | B2 * | 11/2008 | Matsuda et al. | 310/358 |
| 2003/0222944 | A1 * | 12/2003 | Matsuzawa | 347/68 |
| 2009/0284568 | A1 | 11/2009 | Yazaki | |

FOREIGN PATENT DOCUMENTS

| | | | |
|---|---|---|---|
| JP | 2005-088441 | A | 4/2005 |
| JP | 2009-172878 | A | 8/2009 |

* cited by examiner

*Primary Examiner* — Matthew Luu
*Assistant Examiner* — Lisa M Solomon
(74) *Attorney, Agent, or Firm* — Kilpatrick Townsend & Stockton LLP

(57) ABSTRACT

A liquid ejection head comprising a flow-channel-containing substrate having pressure generating chambers communicating a nozzle opening and a piezoelectric element including a first electrode, a piezoelectric layer formed above the first electrode, and a second electrode formed above the piezoelectric layer. The piezoelectric layer includes an active portion which is substantially driven, a non-active portion which is not substantially driven, and a low dielectric material layer which has a dielectric constant lower than that of a center portion of the active portion and which is in the active portion side of the boundary between the active portion and the non-active portion.

11 Claims, 14 Drawing Sheets

LIQUID EJECTION HEAD AND LIQUID EJECTION APPARATUS

CROSS-REFERENCE TO RELATED APPLICATIONS

This application claims the benefit of priority to Japanese Patent Application No. 2010-004641 filed Jan. 13, 2010, the contents of which are hereby incorporated by reference in their entirety.

BACKGROUND

1. Technical Field

The present invention relates to a liquid ejection head having a piezoelectric element and a liquid ejection apparatus.

2. Related Art

Examples of a liquid ejection head include an ink jet printhead having a piezoelectric element made up of first electrode, a piezoelectric layer, and a second electrode on one side of a flow-channel-containing substrate having pressure generating chambers which communicate with nozzle openings, and configured to cause a pressure change in the pressure generating chambers by driving the piezoelectric element and discharge ink drops from the nozzle openings. The piezoelectric element employed in the ink jet printhead has a problem of being susceptible to damage due to an external environment such as humidity. In order to solve this problem, for example, there is a piezoelectric element covered with a second electrode on an outer surface of the piezoelectric layer (see JP-A-2005-88441, for example). In JP-A-2005-88441, the first electrode is a common electrode, and the second electrode is individual electrode.

There is also proposed a configuration in which the first electrodes of the piezoelectric element are provided for the respective pressure generating chambers as the individual electrodes, and the second electrode is provided across the plurality of pressure generating chambers continuously as the common electrode (see JP-A-2009-172878, FIG. 2 and FIG. 4, for example).

However, in the piezoelectric element in which the second electrode is employed as the common electrode as shown in FIG. 2 and FIG. 4 in JP-A-2009-172878, an end of the second electrode in the longitudinal direction of the pressure generating chamber is disposed in an area opposing the pressure generating chamber. Therefore, there arises a difference in rigidity between an area where the second electrode is disposed and an area where the second electrode is not disposed. Simultaneously, since the area where the second electrode is disposed and the area where the second electrode is not disposed define an boundary between an area where an electric field is generated (active portion) and an area where the electric field is not generated (non-active portion), a stress concentration occurs at the boundary between the active portion and the non-active portion, which leads to a probability of occurrence of destruction such as cracks in the piezoelectric layer.

The problem as described above exists not only in the ink jet printhead, but also in the liquid ejection head which ejects liquid other than ink.

SUMMARY

An advantage of some aspects of the invention is to provide a liquid ejection head which can reduce the probability of destruction of the piezoelectric element by alleviating a stress concentration on the piezoelectric element and a liquid ejection apparatus.

A first aspect of the invention is a liquid ejection head including: a flow-channel-containing substrate having pressure generating chambers arranged transversely to a longitudinal direction of the chambers, the chambers each communicating a nozzle opening; and piezoelectric elements disposed on one side of the flow-channel-containing substrate corresponding to the pressure generating chambers, the piezoelectric elements each including a first electrode, a piezoelectric layer disposed on the first electrode, and a second electrode provided on the piezoelectric layer, wherein the first electrode is dividedly provided corresponding to each of the pressure generating chambers, and the second electrode is continuously disposed in the transverse to the longitudinal direction of the pressure generating chambers, the piezoelectric layer includes an active portion which is substantially driven and a non-active portion which is not substantially driven, and a low dielectric material layer having a dielectric constant lower than that of a center portion of the active portion is disposed along the longitudinal direction of the pressure generating chambers, and disposed between the first electrode and the second electrode at least in the active portion of the two portions facing an boundary between the active portion and the non-active portions.

In this configuration, with the provision of the low dielectric material layer in the active portion at the boundary between the active portion and the non-active portion of the piezoelectric layer, the electric field to be applied to the piezoelectric layer at the boundary is reduced, and hence the amount of displacement is reduced. Accordingly, the stress concentration at the boundary between the active portion and the non-active portion is reduced, so that the probability of occurrence of the destruction of the piezoelectric element is reduced.

Preferably, the width of the low dielectric material layer covering the surface of the first electrode gradually increases from the side of the active portion toward the boundary. In this configuration, the area in which the electric field to be applied to the piezoelectric layer at the boundary on the side of the active portion can be gradually reduced toward the boundary and concentration of the stress at the boundary is further restricted.

Preferably, the low dielectric material layer is disposed across the active portion and the non-active portion. In this configuration, even when the electric field is applied to the non-active portion in the vicinity of the active portion, the applied electric field is reduced by the low dielectric material layer.

The low dielectric material layer may be formed so that the width of the low dielectric material layer covering the surface of the first electrode is gradually increased from the active portion to the non-active portion.

Preferably, the low dielectric material layer includes a tapered portion which covers the surface of the first electrode so that the width of the exposed surface of the first electrode is gradually reduced toward the boundary, and a side surface of the tapered portion is provided at an angle of 45° or smaller with respect to a side surface of the first electrode. In this configuration, the stress concentration at the boundary between the active portion and the non-active portion can be reliably reduced by forming the portion tapered at a predetermined angle.

Preferably, the low dielectric material layer has a crystalline structure different from that of the center portion of the active portion. Preferably, the low dielectric material layer is provided on the first electrode. In this configuration, by forming the piezoelectric layer on the low dielectric material layer by a thin film forming method, the crystallinity on the low dielectric material layer can be reduced to reduce the displacement characteristics, and the probability of occurrence of the stress concentration at the boundary can be reduced.

Preferably, an extended portion extending to the outside of the piezoelectric layer is provided on one end side of the first electrode in the direction intersecting the direction of arrangement of the pressure generating chambers, and the low dielectric material layer is provided at least at a portion opposite to the extended portion with respect to the boundary between the active portion and the non-active portion of the piezoelectric layer. In this configuration, in the extended-portion side of the piezoelectric layer with respect to the boundary between the active portion and the non-active portion, the rigidity of the piezoelectric layer changes gradually due to the existence of the extended portion. Therefore, the destruction can hardly occur in this part of the piezoelectric layer in comparison with the opposite side from the extended portion. Therefore, with the provision of the tapered portion of the low dielectric material layer whose width is gradually reduced from the extended portion to the boundary in the opposite side, which is area susceptible to destruction, the stress concentration can be reduced in the area susceptible to destruction.

The low dielectric material layer may also be provided at the side of the extended portion with respect to the boundary between the active portion and the non-active portion of the piezoelectric layer. In this configuration, the probability of occurrence of the destruction at the boundary on the side of the extended portion, which may not be destructed, is surely reduced.

Preferably, the low dielectric material layer in the area of the active portion is symmetrically formed with respect to the boundary. In this configuration, the tapered portion can easily be formed and the deflection of dispersion of the stress is prevented, so that the stable displacement is achieved.

A second aspect of the invention is a liquid ejection apparatus having the liquid ejection head as described above. In this configuration, the liquid ejection apparatus improved in reliability and durability is achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail on the basis of embodiments.

First Embodiment

Figure 1:
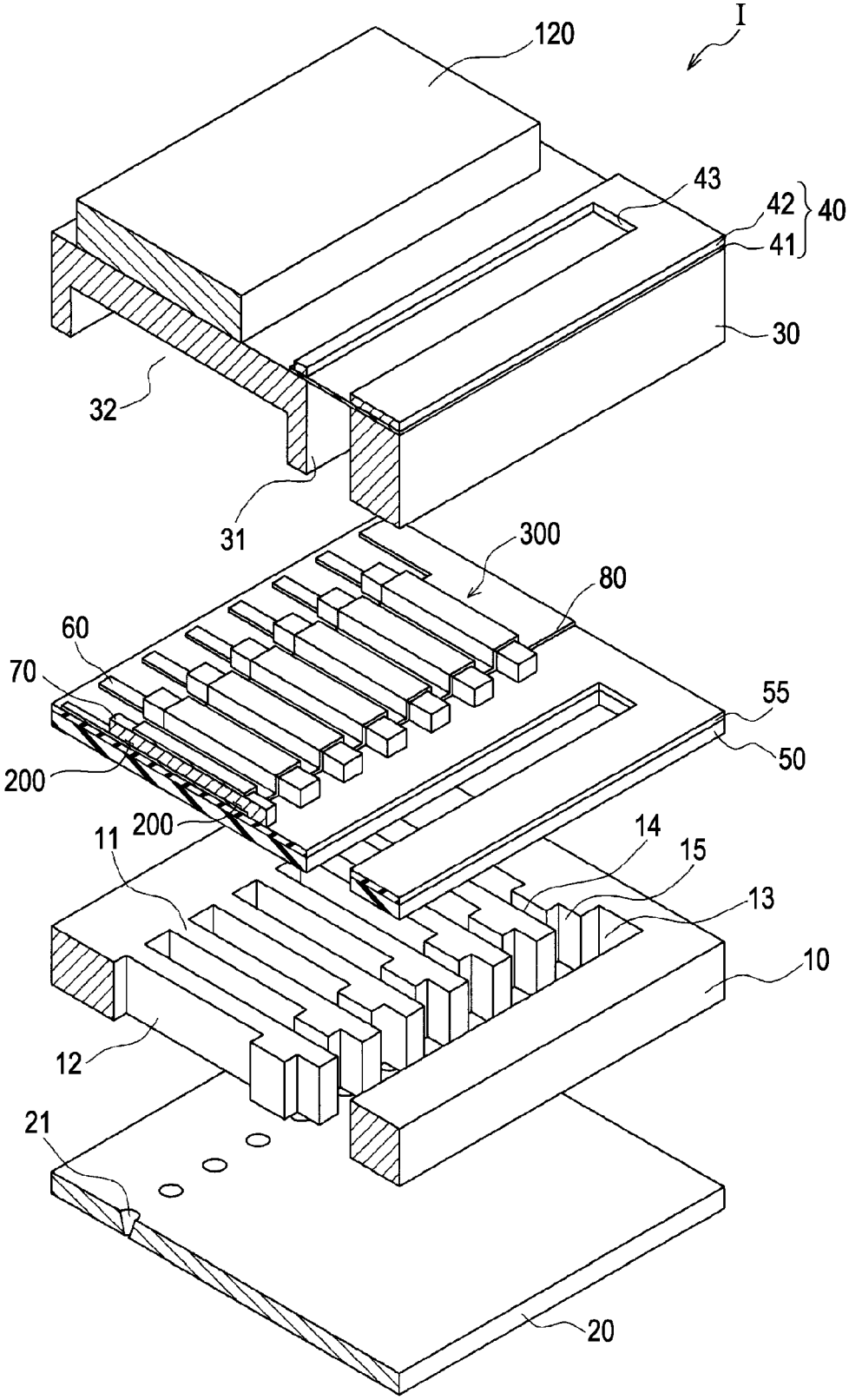
FIG. 1 is an exploded perspective view of a printhead according to a first embodiment.
Figure 2A:
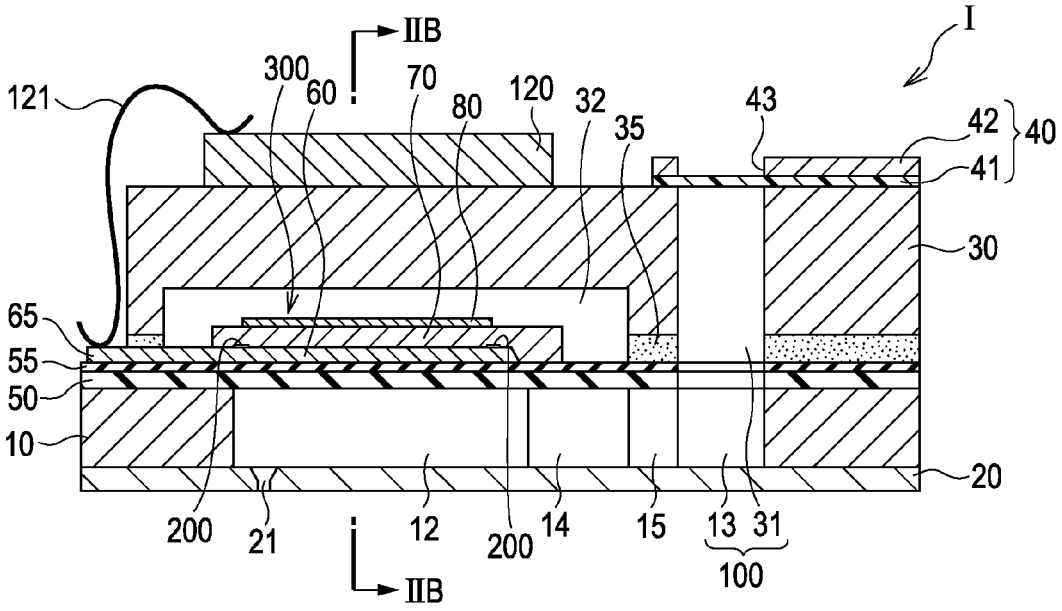
FIGS. 2A and 2B are cross-sectional views showing the printhead according to the first embodiment.
Figure 2B:
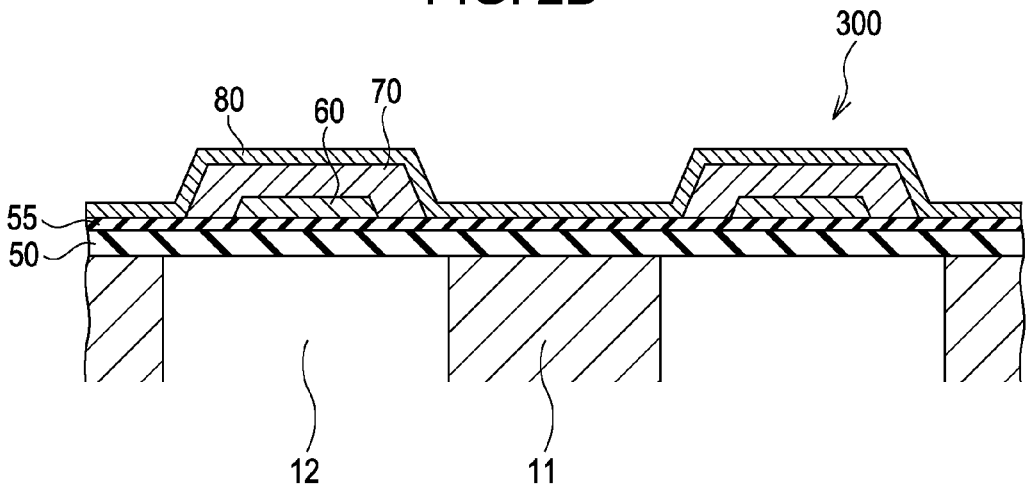

FIG. 1 is an exploded perspective view of an ink jet printhead as an example of a liquid ejection head according to a first embodiment of the invention. FIG. 2A is a cross-sectional view of the ink jet printhead, and FIG. 2B is an enlarged cross-sectional view taken along the line IIB-IIB in FIG. 2A.

As illustrated in the drawings, a flow-channel-containing substrate 10 in this embodiment is formed of a silicon monocrystal substrate, and is formed with a resilient film 50 formed of silicon dioxide on one of the surfaces thereof.

The flow-channel-containing substrate 10 is formed with a plurality of pressure generating chambers 12 arranged in a line in the direction of width thereof. The flow-channel-containing substrate 10 is formed with a communicating portion 13 in an area lengthwise outside of the pressure generating chambers 12, and the communicating portion 13 and the respective pressure generating chambers 12 are communicated via ink supply channels 14 and communicating channels 15 provided corresponding to the respective pressure generating chambers 12. The communicating portion 13 communicates with a manifold portion 31 formed in a protection substrate, described later, and constitutes part of a manifold, which corresponds to an ink chamber common to the respective pressure generating chambers 12. The ink supply channels 14 are formed to have a width narrower than the pressure generating chambers 12 to maintain a flow channel resistance with respect to the ink flowing from the communicating portion 13 into the pressure generating chamber 12 to be constant. In this embodiment, the ink supply channels 14 are formed by reducing the width of the flow channels from one side. However, the width of the flow channels may be reduced from both sides. It is also possible to form the ink supply channel by reducing the thickness instead of reducing the width.

In this embodiment, the flow-channel-containing substrate 10 is provided with a liquid flow channel including the pressure generating chambers 12, the communicating portion 13, the ink supply channels 14, and the communicating channels 15.

A nozzle plate 20 formed with nozzle openings 21 which communicate with the respective pressure generating chambers 12 at positions in the vicinity of end portions opposite from the ink supply channels 14 is fixed to the flow-channel-containing substrate 10 on the opening surface side with an adhesive agent, a thermal welding film or the like. The nozzle plate 20 is formed of, for example, glass ceramics, silicon monocrystalline substrate, stainless steel, and so on.

In contrast, the resilient film 50 as described above is formed on the flow-channel-containing substrate 10 opposite from the opening surface, and an insulating film 55 is formed on the resilient film 50. First electrodes 60, piezoelectric layers 70, and a second electrode 80 are laminated on the insulating film 55 and constitute a piezoelectric element 300. The piezoelectric element 300 here includes the first electrodes 60, the piezoelectric layers 70, and the second electrode 80. In general, one of the electrodes of the piezoelectric element 300 is used as a common electrode, and the other electrode and the piezoelectric layer 70 are formed by patterning for each pressure generating chamber 12. Portions where piezoelectric distortion occurs by the application of a voltage to both electrodes in areas of the piezoelectric layers 70 having two electrodes disposed on either side are referred to as active portions 320. In this embodiment, the first electrodes 60 are provided for the respective pressure generating chambers 12 as individual electrodes of the piezoelectric element 300, and the second electrode 80 is disposed across the plurality of pressure generating chambers 12 as the common electrode. In other words, areas of the piezoelectric layers 70 which are substantially driven by being placed between the first electrodes 60 and the second electrode 80 are active portions 320, and areas of the piezoelectric layer 70, which have only one of the electrodes 60 and 80 or having no electrode and hence are not substantially driven are non-active portions 330. Here, the apparatus having a displaceable piezoelectric element 300 is referred to as an actuator apparatus. In the example described above, the resilient film 50, the insulating film 55, and the first electrodes 60 serve as diaphragms. However, the invention is not limited thereto, and may be configured in such a manner that the resilient film 50 and the insulating film 55 are not provided and only the first electrodes 60 serves as the diaphragms as a matter of course. Alternatively, the piezoelectric element 300 by itself may be configured to serve substantially as the diaphragm.

Figure 3A:
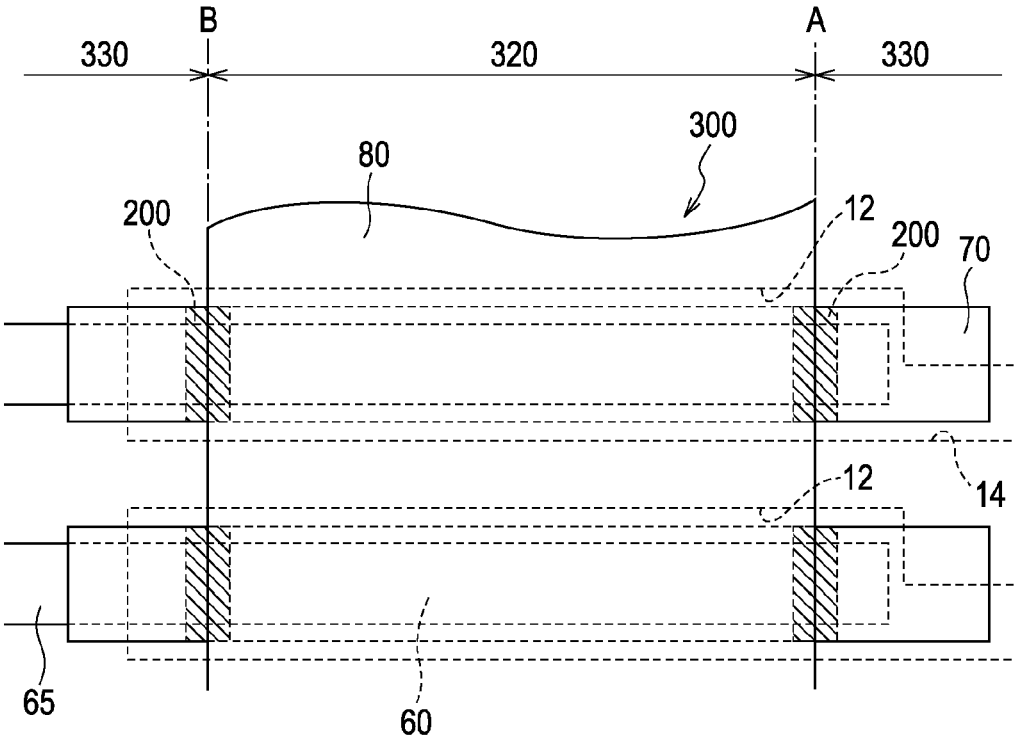
FIGS. 3A and 3B are an enlarged plan view and a cross-sectional view showing a principal portion of the printhead according to the first embodiment.
Figure 3B:
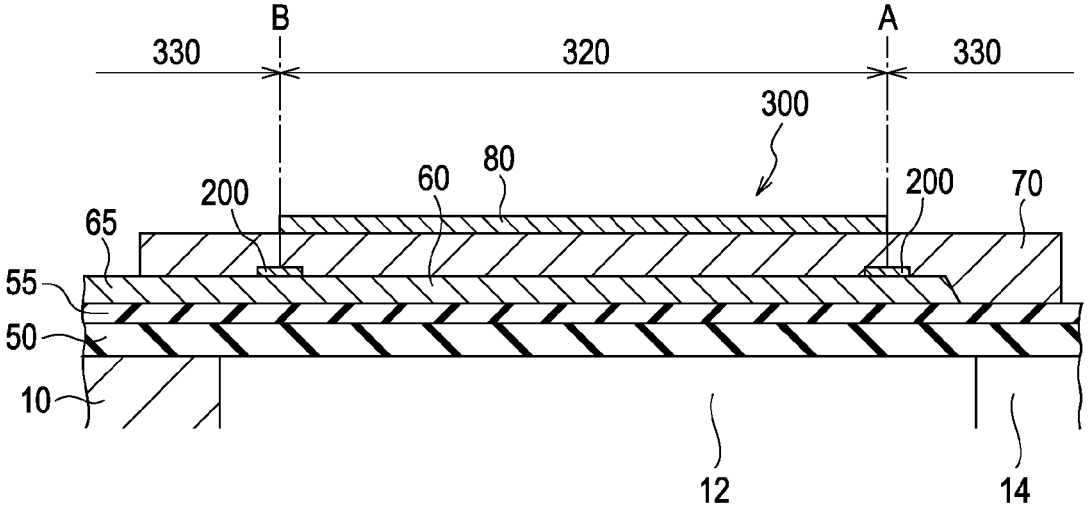
Figure 4:
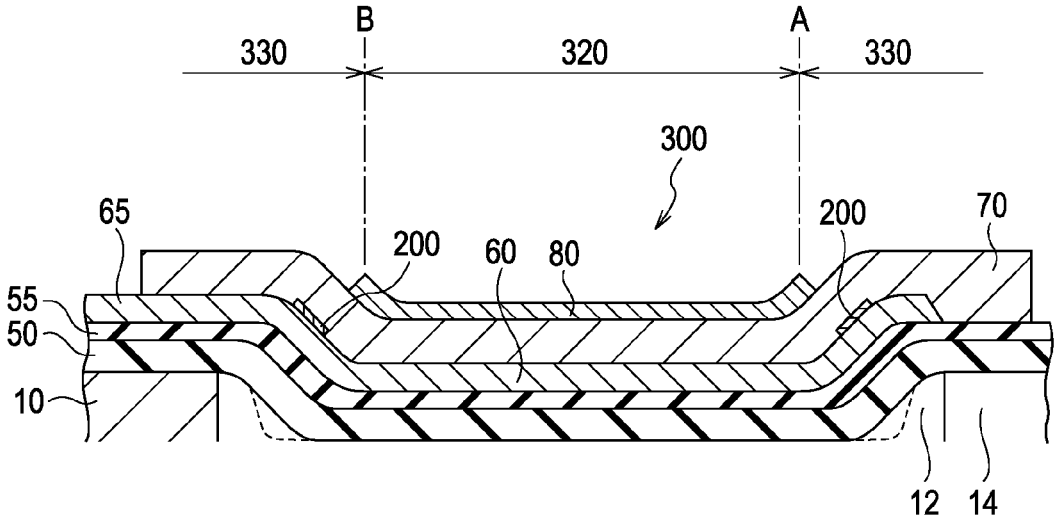
FIG. 4 is a cross-sectional view showing a state of driving of the printhead according to the first embodiment.

Referring now to FIGS. 3A and 3B and FIG. 4, the configuration of the piezoelectric element 300 will be described in detail.

As shown in FIGS. 3A and 3B and FIG. 4, the first electrode 60 which constitutes the piezoelectric element 300 is provided independently corresponding to each of the pressure generating chambers 12. Here, the phase "the first electrode 60 which constitutes the piezoelectric element 300 is provided independently corresponding to each of the pressure generating chambers 12" means that the first electrode 60 is cut into pieces so as to be discontinuous in the direction of arrangement of the pressure generating chambers 12. In this embodiment, by forming the first electrode 60 to have a width narrower than the width of the short side of the each pressure generating chamber 12 (the width in the direction of arrangement of the pressure generating chambers 12), the first electrode 60 is provided independently corresponding to each of the pressure generating chambers 12.

The first electrode 60 provided independently for each of the pressure generating chambers 12 is prevented from being electrically continuous with respect to each other, and hence functions as the individual electrode of the piezoelectric element 300.

The each first electrode 60 is provided with an extended portion 65, which extends outward from the end of the piezoelectric layer 70, at an end opposite from the ink supply channel 14 in the longitudinal direction of the pressure generating chamber 12. The end portion of the extended portion 65 is exposed without being covered by the piezoelectric layer 70, thereby serving as a connecting terminal to which a drive circuit 120, described later in detail is electrically connected. In other words, the first electrode 60 also functions as a lead which is led from the piezoelectric element 300 and connected to the drive circuit 120. It is also possible to provide an electrically conductive line as a lead separately from the first electrode 60 as a matter of course.

The piezoelectric layer 70 is wider than the first electrode 60 in the short direction of the pressure generating chamber 12 (the direction of arrangement of the pressure generating chambers 12), and narrower than the width of the short side of the pressure generating chamber 12. The piezoelectric layer 70 covers end surfaces of the first electrode 60 in the width direction.

The piezoelectric layer 70 is provided so as to be longer than the pressure generating chamber 12 in the longitudinal direction of the pressure generating chamber 12 (the direction orthogonal to the direction of arrangement of the pressure generating chambers 12). In this embodiment, the piezoelectric layer 70 is formed to have a size which can cover an end of the first electrode 60 on the side of the ink supply channel 14 in the longitudinal direction of the pressure generating chamber 12.

The piezoelectric layer 70 is formed to be shorter than the end of the first electrode 60 opposite from the communicating portion 13 in the longitudinal direction of the pressure generating chamber 12 to expose part of the lead of the first electrode 60. The drive circuit 120 is electrically connected to the exposed end of the first electrode 60.

The piezoelectric layer 70 is formed of a piezoelectric material having an electromechanical transducing action such as a ferroelectric material having a perovskite structure and containing Zr or Ti as metal, for example, a ferroelectric material such as lead zirconate titanate (PZT), or the ferroelectric material added with metallic oxide such as niobium oxide, nickel oxide, or magnesium oxide. More specifically, lead zirconate titanate ($Pb(Zr,Ti)O_3$), barium zirconate titanate ($Ba(Zr, Ti)O_3$), lead lanthanum zirconate titanate ($(Pb,La)(Zr,Ti)O_3$) or lead magnesium niobate zirconium titanate ($Pb(Zr,Ti)(Mg,Nb)O_3$) are exemplified.

The thickness of the piezoelectric layer 70 is not specifically limited, and may be set to be thin enough without causing occurrence of cracks in the manufacturing process and thick enough to demonstrate a sufficient displacement characteristics. For example, a desired crystalline structure is easily obtained by forming the piezoelectric layer 70 to a thickness of approximately 0.2 to 5 μm. In this embodiment, the film thickness of the piezoelectric layer 70 is set to 1.2 μm in order to obtain optimal piezoelectric properties.

The method of manufacturing the piezoelectric layer 70 is not specifically limited. For example, the piezoelectric layer 70 may be formed using a so-called sol-gel process, which is a process of obtaining the piezoelectric layer 70 formed of metallic oxide by applying and drying organic metallic compound dissolved and dispersed into solvent, so-called sol, and gelatinizing the same, and then baking the same at a high temperature. The method of manufacturing the piezoelectric layer 70 is not limited to the sol-gel process, and a MOD (Metal-Organic Decomposition) method or a spattering method may be used as a matter of course.

In this embodiment, the piezoelectric layer 70 is provided independently for each of the pressure generating chambers 12. However, the invention is not limited thereto, and the piezoelectric layer 70 may be disposed continuously across the plurality of pressure generating chambers 12. In this embodiment, the piezoelectric layer 70 is cut into pieces and provided independently for each of the pressure generating chambers 12. Therefore, the piezoelectric layer 70 does not hinder the displacement of the piezoelectric element 300.

The second electrode 80 is disposed continuously across the direction of arrangement of the plurality of pressure generating chambers 12. Here, the phrase "the second electrode 80 is disposed continuously across the direction of arrangement of the plurality of pressure generating chambers 12" includes those continuing across the adjacent pressure generating chambers 12 as shown in FIG. 3A and those cut off partly between the adjacent pressure generating chambers 12.

The second electrode 80 is disposed within an area opposing the pressure generating chamber 12 in the longitudinal direction of the pressure generating chamber 12 (the direction orthogonal to the direction of arrangement of the pressure generating chambers 12). In other words, the second electrode 80 is disposed in such a manner that ends extending in longitudinal direction of the second electrode 80 (the longitudinal direction of the pressure generating chamber 12) are positioned in an area of the pressure generating chamber 12.

The second electrode 80 is disposed also in such a manner that the end of the second electrode 80 on the side of the extended portion 65 of the first electrode 60 is positioned within the first electrode 60 (the center side of the pressure generating chamber 12), that is, the end is positioned on the side of the pressure generating chamber 12 with respect to the first electrode 60, so that the second electrode 80 defines the ends of the active portion 320 of the piezoelectric layer 70 in the longitudinal direction thereof.

In the piezoelectric element 300 including the first electrode 60, the piezoelectric layer 70, and the second electrode 80 as described above, the short side ends (widthwise ends) of the active portion 320 as substantial driving portion of the piezoelectric layer 70 are defined by the widthwise (the direction of the short sides and the direction of arrangement of the pressure generating chambers 12) ends of the first electrode 60, and the ends (length) of the active portion 320 in the longitudinal direction are defined by the ends of the second electrode 80 in the longitudinal direction (the longitudinal direction of the pressure generating chamber 12). Other areas of the piezoelectric layer 70, that is, areas where only one or none of the first electrode 60 and the second electrode 80 is provided are non-active portions 330. Therefore, the boundaries between the active portion 320 and the non-active portions 330 are defined by the first electrode 60 and the second electrode 80. Here, in this embodiment, the boundaries between the active portion 320 and the non-active portions 330 in the longitudinal direction of the pressure generating chamber 12 are expressed as an boundary A on the side of the ink supply channel 14, and an boundary B on the opposite side from the ink supply channel 14 (the side of the extended portion 65).

Provided above the first electrode 60 of the piezoelectric element 300, that is, on the side of the second electrode 80 are low dielectric material layers 200.

The low dielectric material layer 200 is provided on the side of the active portion 320 of the boundary A, which is one of the boundaries A and B between the active portion 320 and the non-active portions 330 in the direction intersecting the direction of arrangement of the pressure generating chambers 12 (the longitudinal direction of the pressure generating chamber 12). In this embodiment, the low dielectric material layer 200 is provided continuously so as to extend across the active portion 320 and the non-active portion 330, that is, across the boundary A.

The low dielectric material layer 200 configured in this manner is provided immediately above the first electrode 60, that is, between the first electrode 60 and the piezoelectric layer 70. In this embodiment, the low dielectric material layer 200 is provided across the width of the piezoelectric layer 70 (in the direction of arrangement of the piezoelectric elements 300).

The low dielectric material layer 200 is formed of a material having a dielectric constant lower than that of the piezoelectric layer 70 positioned at the center of the active portion 320. More specifically, a ceramics material may be used as the low dielectric material layer 200, and $TiO_2$, $ZrO_2$, $PbTiO_3$, $SiO_2$, $BaTiO_3$, $SrTiO_3$, $LaFeO_3$, $BiFeO_3$ are exemplified as the ceramics material. When lead zirconate titanate is used as the piezoelectric layer 70, the same material as the piezoelectric layer 70 having a dielectric constant lower than that of the piezoelectric layer 70 such as $PbTiO_3$ or $PbZrTiO_3$ is preferably used as the low dielectric material layer 200. In this manner, lead zirconate titanate having a dielectric constant lower than that of the material of the piezoelectric layer 70 may be obtained by selecting lead zirconate titanate containing a larger amount of titanium (Ti) than that of the piezoelectric layer 70. By using the same material as the piezoelectric layer 70 but having a dielectric constant lower than that of the piezoelectric layer 70 for the low dielectric material layer 200, generation of a large difference in characteristics such as rigidity or Young's modulus between the piezoelectric layers 70 and the low dielectric material layer 200 is prevented, lowering of the displacement characteristics of the entire piezoelectric element 300 is prevented, and the probability of occurrence of ply separation between the low dielectric material layer 200 and the piezoelectric layer 70 or the first electrode 60 is reduced.

In this embodiment, the low dielectric material layer 200 is also provided on the boundary B between the active portion 320 and the non-active portion 330 on the side opposite from the ink supply channel 14 in the longitudinal direction of the pressure generating chamber 12 between the first electrode 60 and the second electrode 80 on the side of the active portion 320. In this embodiment, on the boundary B as well, the low dielectric material layer 200 is provided so as to extend across the active portion 320 and the non-active portion 330, that is, across the boundary B in the same manner as the low dielectric material layer 200 on the side of the boundary A.

The each first electrode 60 is provided with the extended portion 65, which extends to the outside of the piezoelectric layer 70 as described above, on the opposite side from the ink supply channel 14. The extended portion 65 extends to the outside of the pressure generating chamber 12 continuously from the first electrode 60 positioned in the active portion 320, and a connection wiring 121 of the drive circuit 120, described later, is connected to the extended end of the extended portion 65.

In this manner, with the provision of the low dielectric material layer 200 above the first electrode 60 across the active portion 320 and the non-active portion 330 thereof, an electric field applied to the piezoelectric layer 70 is reduced in the vicinity of the end (the boundary A) of the active portion 320 where the low dielectric material layer 200 is provided. Since the amount of displacement of the piezoelectric layer 70 varies according to the strength of the electric field, the amount of displacement in the area across the boundary A where the low dielectric material layer 200 is provided between the first electrode 60 and the second electrode 80 is reduced in comparison with the center portion of the active portion 320 (the area constituted only by piezoelectric layer 70). In the non-active portions 330, no electric field is applied to the piezoelectric layer 70. In this manner, in the longitudinal direction of the pressure generating chamber 12, the piezoelectric layer 70 has the area where the electric field is applied (the active portion 320) and the areas where the electric field is not applied (the non-active portions 330). In the area where the electric field is applied (the active portion 320) includes the center side where the amount of displacement is large (the area where the low dielectric material layer 200 is not provided) and the boundary area between the active portion 320 and the non-active portion 330 (the boundary A and the vicinity thereof) where the amount of displacement is smaller than the center portion. When the voltage is applied to deform the piezoelectric element 300 having no low dielectric material layer 200 provided therein, deformation shown by broken line in FIG. 4 is achieved, and hence the stress concentration occurs at the boundary A between the active portion 320 and the non-active portions 330. It is because that the difference in rigidity due to the presence or absence of the second electrode 80 occurs at the boundary A between the active portion 320 provided with the second electrode 80 and the non-active portion 330 not provided with the second electrode 80. The stress concentration at the boundary A occurs also in such circumstance that the electric field is applied to the active portion 320 and hence the deformation occurs, and the electric field is not applied to the non-active portion 330 and hence no spontaneous deformation occurs (the deformation following the deformation of the active portion 320 may occur).

However, in this embodiment, with the provision of the low dielectric material layer 200, a lower electric field can be applied to the piezoelectric layer 70 at the end portion (the boundary A) of the active portion 320 on the side of the non-active portion 330 in comparison with the electric field applied to the center side of the active portion 320, so that the amount of displacement of the piezoelectric layer 70 on the side of the non-active portion 330 can be reduced. Accordingly, as shown in FIG. 4, the angle of inclination of the boundary A and the vicinity thereof when the piezoelectric element 300 is displaced can be made less severe, so that the concentration of the stress on the piezoelectric layer 70 at the boundary A and the vicinity thereof can be reduced, and probability of occurrence of destruction such as cracks is reduced.

In this embodiment, the low dielectric material layers 200 are provided on the active portion 320 and the non-active portion 330 across the boundary A. In other words, the low dielectric material layer 200 is provided also at the end of the non-active portion 330 (the side of the boundary A) on the side of the active portion 320. The low dielectric material layer 200 may not be provided on the non-active portion 330 as long as it is provided on the side of the active portion 320 as a matter of course.

In this embodiment, the low dielectric material layer 200 continuing across the active portion 320 and the non-active portion 330 is also provided on the first electrode 60 at the boundary B between the active portion 320 and the non-active portion 330 on the side of the extended portion 65. Therefore, in the same manner as the low dielectric material layer 200 on the side of the boundary A described above, the stress concentration on the piezoelectric layer 70 at the boundary portions on the side of the boundary B may also be reduced by the low dielectric material layer 200 provided on the side of the boundary B, so that the probability of occurrence of the destruction such as cracks is reduced.

On the side of the boundary A between the active portion 320 and the non-active portion 330, the first electrode 60 is provided in the non-active portion 330. However, the first electrode 60 is provided so as to terminate inside the longitudinal end of the pressure generating chamber 12. In contrast, in the non-active portion 330 on the side of the boundary B between the active portion 320 and the non-active portion 330, the first electrode 60 (the extended portion 65) is disposed to the outside of the end of the pressure generating chamber 12. Therefore, in comparison with the vicinity of the boundary B, there arises a large difference between the rigidity of the non-active portion 330 and the rigidity of the active portion 320 in the areas opposing the pressure generating chamber 12 in the vicinity of the boundary A. Therefore, the low dielectric material layer 200 is preferably disposed at least at the boundary A.

In this embodiment, the low dielectric material layers 200 are disposed at both the boundaries A and B on the side of the ink supply channels 14 and on the side of the extended portions 65. Therefore, the two low dielectric material layers 200 are provided in symmetry in the longitudinal direction in the area corresponding to the active portion 320.

By using a material different in crystallinity from that of the piezoelectric layer 70 as the low dielectric material layer 200, the crystallinity of the piezoelectric layer 70 formed on the first electrode 60 and the crystallinity of the piezoelectric layer 70 formed on the low dielectric material layer 200 can be differentiated. More specifically, when the piezoelectric layer 70 is brought into a crystal growth by an epitaxial growth on the low dielectric material layer 200, a piezoelectric layer 70 having a crystallinity lower than that of the piezoelectric layer 70 formed on the first electrode 60 is formed by the influence of the crystallinity of the low dielectric material layer 200 as a base material. Accordingly, the piezoelectric layer 70 formed on the low dielectric material layer 200 has a lower piezoelectric properties than that in other areas, which also contribute to lower the amount of displacement of the piezoelectric layer 70 on the low dielectric material layer 200, and reduce the stress concentration at the boundaries A and B between the active portion 320 and the non-active portions 330 and in the vicinity thereof.

In this embodiment, the low dielectric material layer 200 is provided between the first electrode 60 and the piezoelectric layer 70. However, the invention is not limited thereto. For example, the low dielectric material layer 200 may be provided at a midsection of the piezoelectric layer 70 in the thickness direction or between the piezoelectric layer 70 and the second electrode 80. However, with the provision of the low dielectric material layer 200 where the piezoelectric layer 70 exists on the low dielectric material layer 200, that is, in the midsection of the piezoelectric layer 70 in the thickness direction or between the first electrode 60 and the piezoelectric layer 70 and forming the piezoelectric layer 70 on the low dielectric material layer 200 by a thin film forming method (for example, the spattering, the CVD method, the sol-gel process, etc.) as described above, the crystalline structure in the case where the piezoelectric layer 70 is formed on the first electrode 60 may be differentiated from the crystalline structure in the case where the piezoelectric layer 70 is formed on the low dielectric material layer 200, so that the crystallinity of the piezoelectric layer 70 on the low dielectric material layer 200 can be lowered in comparison with the crystallinity of the piezoelectric layer 70 positioned at the center portion of the active portion 320. Therefore, the piezoelectric layer 70 on the low dielectric material layer 200 can be made less displaceable and hence the stress concentration can be reduced further effectively.

In this embodiment, with the provision of the low dielectric material layer 200 at the boundary B where the extended portion 65 is provided, the stress concentration at the boundary B can be reduced. However, since the low dielectric material layer 200 is not more than being disposed on the first electrode 60, the low dielectric material layer 200 does not increase the electric resistance of the first electrode 60 (the extended portion 65), and the voltage to be applied to the piezoelectric element 300 is not lowered. The electric field to be applied to the piezoelectric layer 70 can be reduced also by narrowing the width of the first electrode 60 in the vicinity of the boundary B or by providing an opening. However, if the width of the first electrode 60 is reduced, or the opening is provided, the resistance of the first electrode is increased, and the voltage to be applied to the piezoelectric element 300 is lowered. In this embodiment, since the first electrode 60 is not deformed, the electric resistance of the first electrode 60 is not increased.

On the flow-channel-containing substrate 10 formed with the piezoelectric elements 300, that is, on the first electrodes 60 and the insulating film 55, a protection substrate 30 having the manifold portion 31, which constitutes at least part of a manifold 100, is bonded via an adhesive agent 35. The manifold portion 31 in this embodiment is formed across the widthwise direction of the pressure generating chamber 12 so as to penetrate through the protection substrate 30 in the thickness direction, and is communicated with the communicating portion 13 of the flow-channel-containing substrate 10 as described above, thereby constituting the manifold 100 which serves as a common ink chamber for the respective pressure generating chambers 12. The communicating portion 13 of the flow-channel-containing substrate 10 may be divided into a plurality of portions for the respective pressure generating chambers 12 to use only the manifold portion 31 as the manifold. Furthermore, for example, it is also possible to provide only the pressure generating chambers 12 on the flow-channel-containing substrate 10, and provide the ink supply channels 14 which communicate the manifold and the respective pressure generating chambers 12 on a member (for example, the resilient film 50, the insulating film 55, etc.) interposed between the flow-channel-containing substrate 10 and the protection substrate 30.

In the area of the protection substrate 30 opposing the piezoelectric elements 300, a piezoelectric element holding portion 32 having a space which does not hinder the movement of the piezoelectric elements 300 is provided. The piezoelectric element holding portion 32 only have to have a space to an extent which can prevent the hindrance of the movement of the piezoelectric element 300, and the space may be sealed or may not be sealed.

The protection substrate 30 is preferably formed of a material having substantially the same coefficient of the thermal expansion as the flow-channel-containing substrate 10, for example, glass, ceramic material, and so on. In this embodiment, a silicon monocrystalline substrate, which is the same material as the flow-channel-containing substrate 10 is used.

The drive circuit 120 configured to drive the piezoelectric elements 300 arranged in a line is fixed onto the protection substrate 30. As the drive circuit 120, a circuit substrate or a semiconductor integrated circuit (IC) and the like may be used. The drive circuit 120 is electrically connected to the first electrode 60 and the second electrode 80 via the connection wiring 121 which is formed of a conductive wire such as the bonding wire.

A compliance substrate 40 including a sealing film 41 and a fixed panel 42 is also bonded onto the protection substrate 30. The sealing film 41 here is formed of a flexible material having a low rigidity and one side of the manifold portion 31 is sealed by the sealing film 41. The fixed panel 42 is formed of a relatively hard material. An area of the fixed panel 42 opposing the manifold 100 is an opening portion 43 removed completely in the thickness direction. Therefore, the one side of the manifold 100 is sealed only with the flexible sealing film 41.

The ink jet printhead in this embodiment as described above is configured in such a manner that after having introduced ink from an ink introduction port connected to an external ink supply unit, not shown, to fill the interior thereof from the manifold 100 to the nozzle openings 21 with ink, voltages are applied to between the first electrodes 60 and the second electrodes 80 corresponding to the respective pressure generating chambers 12 according to the recording signal from the drive circuit 120 to cause the resilient film 50, the insulating film 55, the first electrode 60, and the piezoelectric layer 70 into flexure deformation, whereby the pressures in the respective pressure generating chambers 12 are increased and hence ink droplets are discharged from the nozzle openings 21.

At this time, with the provision of the low dielectric material layer 200 extending across the boundary A between the active portion 320 and the non-active portion 330 at the boundary A between the active portion 320 and the non-active portion 330 on the opposite side from the extended portion 65 of the first electrode 60, the stress concentration at the boundary A between the active portion 320 and the non-active portion 330 is reduced. In the same manner, with the provision of the low dielectric material layer 200 also at the boundary B on the side of the extended portion 65, the stress concentration at the boundary B between the active portion 320 and the non-active portion 330 on the side of the extended portion 65 is also reduced.

A method of manufacturing the ink jet printhead according to the embodiment as described above will be descried. FIGS. 5A to 9C are cross-sectional views showing a method of manufacturing the ink jet printhead according to the first embodiment of the invention.

Figure 5A:
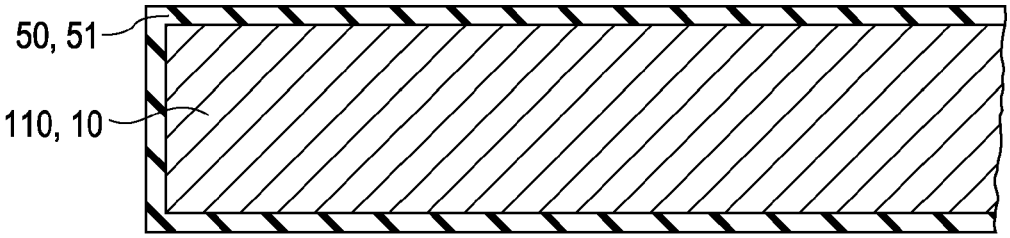
FIGS. 5A, 5B, and 5C are cross-sectional views showing a method of manufacturing the printhead according to the first embodiment.
Figure 5B:
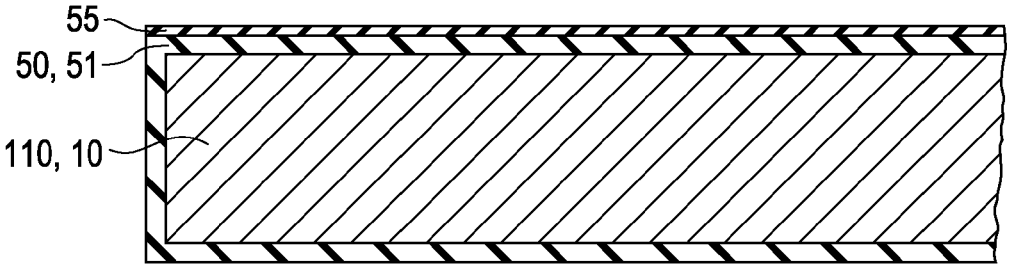

First of all, as shown in FIG. 5A, an oxide film 51 which constitutes the resilient film 50 is formed on the surface of a flow-channel-containing substrate wafer 110, which is a silicon wafer including a plurality of integrally formed flow-channel-containing substrates 10. The method of forming the oxide film 51 is not specifically limited. However, for example, it may be formed by subjecting the flow-channel-containing substrate wafer 110 to thermal oxidation using a diffusion furnace or the like. Subsequently, as shown in FIG. 5B, the insulating film 55 formed of an oxide film of a material different from the resilient film 50 is formed on the resilient film 50 (the oxide film 51).

Figure 5C:
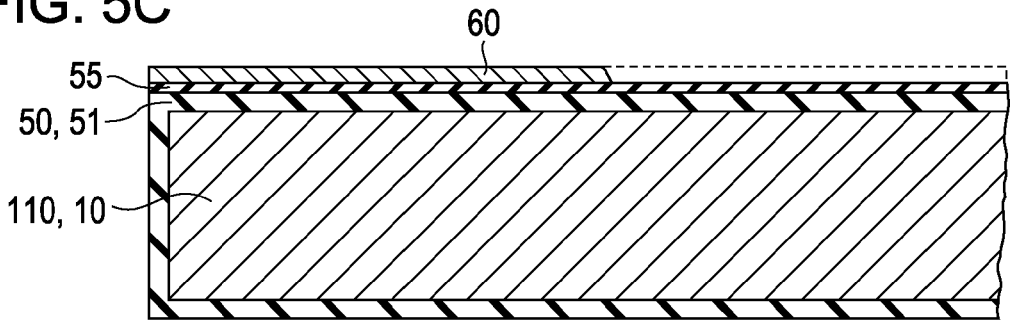

Subsequently, as shown in FIG. 5C, for example, the first electrode 60 formed of platinum and iridium is formed over the entire surface of the insulating film 55. The first electrode 60 may be formed, for example, by the spattering method.

Figure 6A:
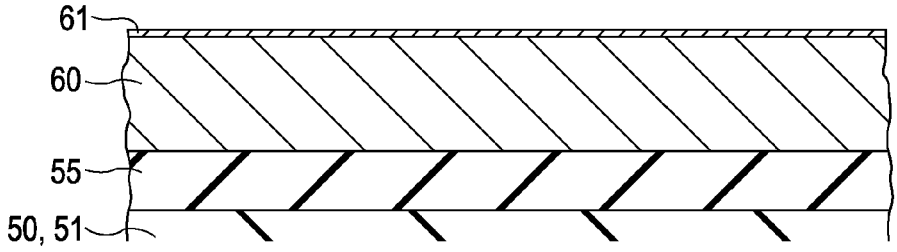
FIGS. 6A, 6B, 6C, and 6D are cross-sectional views showing the method of manufacturing the printhead according to the first embodiment.

Subsequently, as shown in FIG. 6A, a crystal seed layer 61 formed of titanium (Ti) is formed on the first electrode 60. The crystal seed layer 61 is formed to have a thickness of a range from 3.5 to 5.5 nm. The thickness of the crystal seed layer 61 is preferably 4.0 nm. In this embodiment, the crystal seed layer 61 is formed to have a thickness of 4.0 nm. In this embodiment, titanium (Ti) is used as the crystal seed layer 61. However, the crystal seed layer 61 is not specifically limited as long as it serves as a seed crystal of the piezoelectric layer 70 when forming the piezoelectric layer 70 in the subsequent process. For example, titanium oxide ($TiO_2$) may be used as the crystal seed layer 61.

Figure 6B:
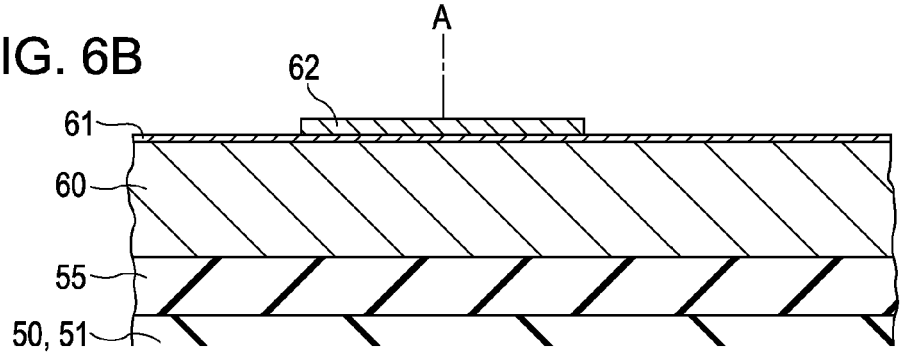

Subsequently, as shown in FIG. 6B, a low dielectric material layer formed layer 62 formed of titanium (Ti) is formed in the areas in which the low dielectric material layers 200 are formed, that is, in this embodiment the area extending across the boundary A and the area extending across the boundary B (not shown). In this embodiment, the low dielectric material layer formed layer 62 is formed to have a thickness of 20 nm. The crystal seed layer 61 and the low dielectric material layer formed layer 62 may be formed by the spattering method. The titanium of the low dielectric material layer formed layer 62 is dispersed in a piezoelectric film 72, described later, which causes oxidation, so that the low dielectric material layer 200 such as $PbTiO_3$ or $TiO_2$ is formed.

Subsequently, the piezoelectric layer 70 formed of lead zirconate titanate (PZT) is formed. Here, in this embodiment, the piezoelectric layer 70 is formed using a so-called sol-gel process, which is a process of obtaining the piezoelectric layer 70 formed of metallic oxide by applying and drying organic metallic compound dissolved and dispersed into solvent, so-called sol, and gelatinizing the same, and then baking the same at a high temperature. The method of manufacturing the piezoelectric layer 70 is not limited to the sol-gel process, and a MOD (Metal-Organic Decomposition) method or a spattering method may be used.

Figure 6C:
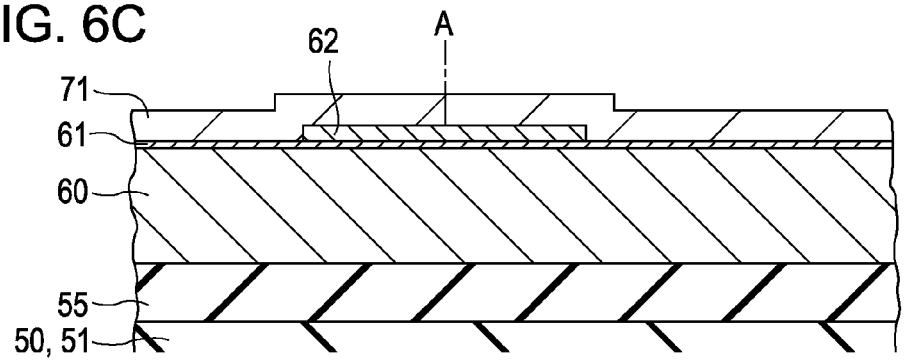
Figure 6D:
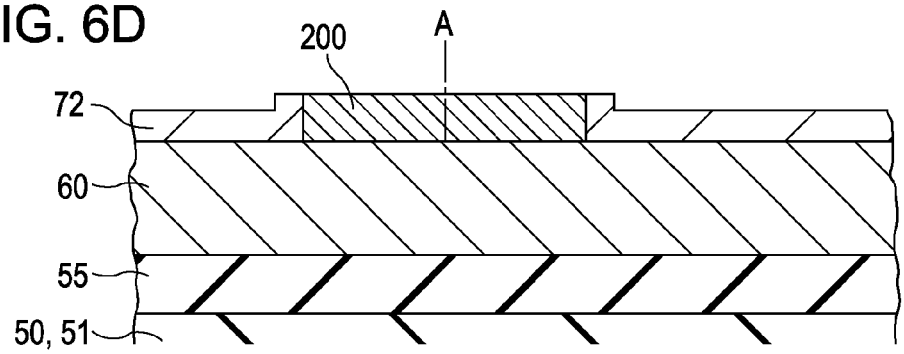

As a detailed procedure of forming the piezoelectric layer 70, firstly, a piezoelectric antecedent film 71 as a PZT antecedent film is formed on the crystal seed layer 61 and the low dielectric material layer formed layer 62 as shown in FIG. 6C. In other words, sol (solution) containing the metal organic compound is applied onto the flow-channel-containing substrate 10 formed with the crystal seed layer 61 and the low dielectric material layer formed layer 62 (application process). Subsequently, the piezoelectric antecedent film 71 is heated to a predetermined temperature to dry the same for a certain period (drying process). Then, the dried piezoelectric antecedent film 71 is degreased by heating the same to a predetermined temperature and maintaining the temperature for a certain period (degreasing process). Subsequently, as shown in FIG. 6D, the piezoelectric antecedent film 71 is crystallized by heating the same to a predetermined temperature and maintaining the temperature for a certain period to form the piezoelectric film 72 (sintering process). By the heating in the sintering process, the titanium in the crystal seed layer 61 and the low dielectric material layer formed layer 62 is dispersed in the film of the piezoelectric film 72. At this time, since a larger amount of titanium is dispersed in the piezoelectric film 72 in the area where the low dielectric material layer formed layer 62 is provided in comparison with other areas (the areas where the low dielectric material layer formed layer 62 is not formed), a titanium-rich PZT is formed on the low dielectric material layer formed layer 62 in comparison with other areas. The titanium-rich PZT containing larger amount of titanium in comparison with other areas has a tetragonal structure, which is different in crystallinity from other areas having a monoclinic structure, and hence has a low dielectric constant so as to be usable as the low dielectric material layer 200. The crystal seed layer 61 and the low dielectric material layer formed layer 62 are dispersed in the piezoelectric film 72. However, it may remain at the boundary between the piezoelectric film 72 and the first electrode 60.

As a heating apparatus used in the drying process, the degreasing process, and the sintering process, for example, a hot plate or a RTP (Rapid Thermal Processing) apparatus which is configured to heat with irradiation from an infrared ray lamp can be used.

Figure 7A:
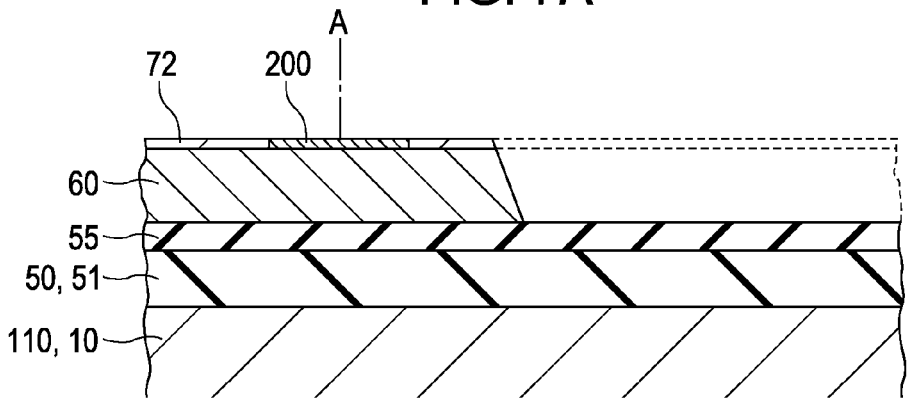
FIGS. 7A and 7B are cross-sectional views showing the method of manufacturing the printhead according to the first embodiment.

Then, as shown in FIG. 7A, in the stage in which the first layer of the piezoelectric film 72 is formed on the first electrode 60, the first electrode 60 and the first layer of the piezoelectric film 72 are simultaneous patterned so that the side surfaces are inclined.

In this manner, by patterning the first layer of the piezoelectric film 72 and the first electrode 60 simultaneously after the first layer of the piezoelectric film 72 is formed, the first layer of the piezoelectric film 72 demonstrates a strong property as a seed for causing the piezoelectric film 72 from a second layer onward to achieve satisfactory crystal growth. Even when an extremely thin alteration film is formed on the surface layer during the patterning, it does not affect the crystal growth of the piezoelectric film 72 from the second layer onward.

Figure 7B:
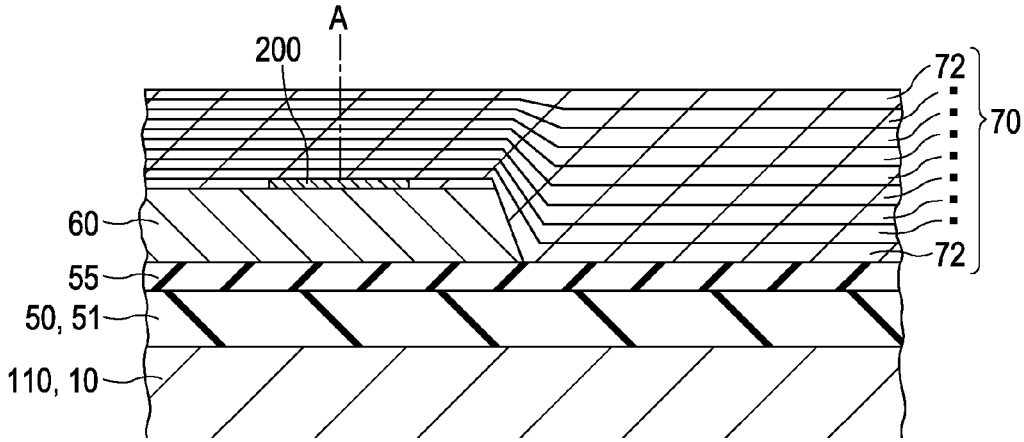

Then, by repeating a piezoelectric film manufacturing process including the application process, the drying process, the degreasing process, and the sintering process as described above a plurality of number of times after the patterning, the piezoelectric layer 70 having a predetermined thickness including a plurality of layers of the piezoelectric film 72 as shown in FIG. 7B is formed. When a plurality of layers of the piezoelectric film 72 is formed, the piezoelectric film 72 formed on the low dielectric material layer 200 as described above has a crystallinity lower than that of the other piezoelectric films 72, so that the displacement characteristics may be lowered.

Figure 8A:
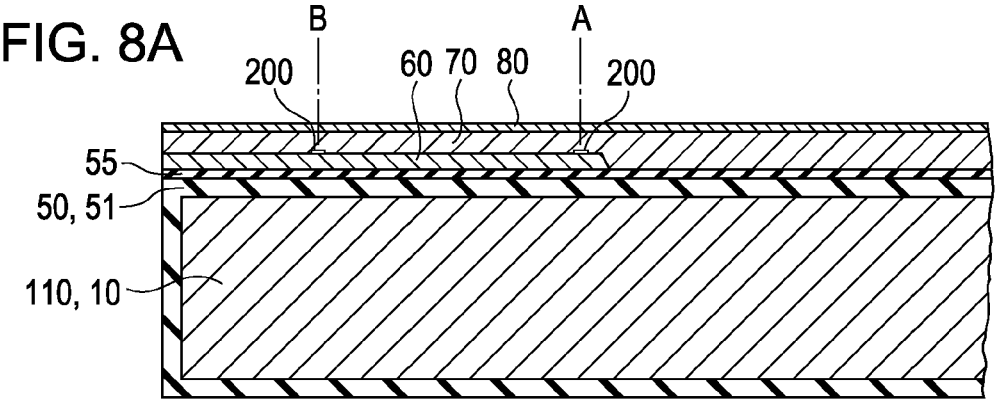
FIGS. 8A, 8B, and 8C are cross-sectional views showing the method of manufacturing the printhead according to the first embodiment.

Subsequently, as shown in FIG. 8A, the second electrode 80 formed of iridium (Ir) is formed on the piezoelectric layer 70.

Figure 8B:
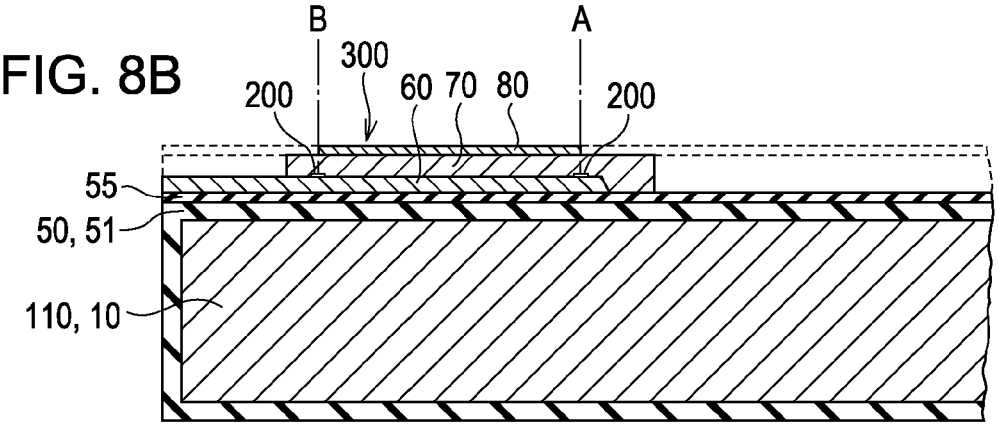

Then, as shown in FIG. 8B, the piezoelectric layer 70 and the second electrode 80 are patterned in areas opposing the respective pressure generating chambers 12 to form the piezoelectric elements 300.

Figure 8C:
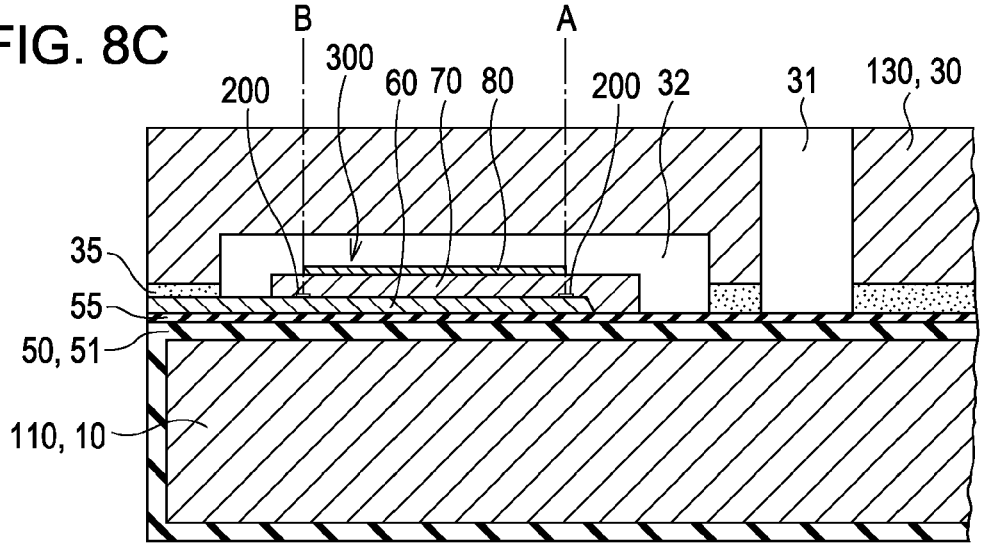
Figure 9A:
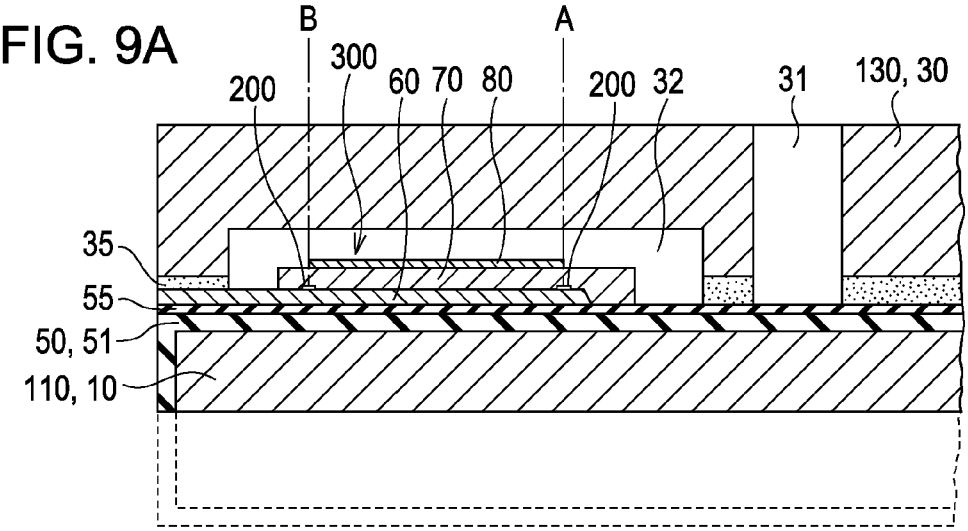
FIGS. 9A, 9B, and 9C are cross-sectional views showing the method of manufacturing the printhead according to the first embodiment.

Subsequently, as shown in FIG. 8C, a protection substrate wafer 130 which is a silicon wafer including the plurality of protection substrates 30 is bonded to the flow-channel-containing substrate wafer 110 on the side of the piezoelectric elements 300 via the adhesive agent 35. The protection substrate wafer 130 has a thickness of, for example, on the order of several hundreds μm, the rigidity of the flow-channel-containing substrate wafer 110 is dramatically improved by boding the protection substrate wafer 130. Then, as shown in FIG. 9A, the flow-channel-containing substrate wafer 110 is formed into a predetermined thickness.

Figure 9B:
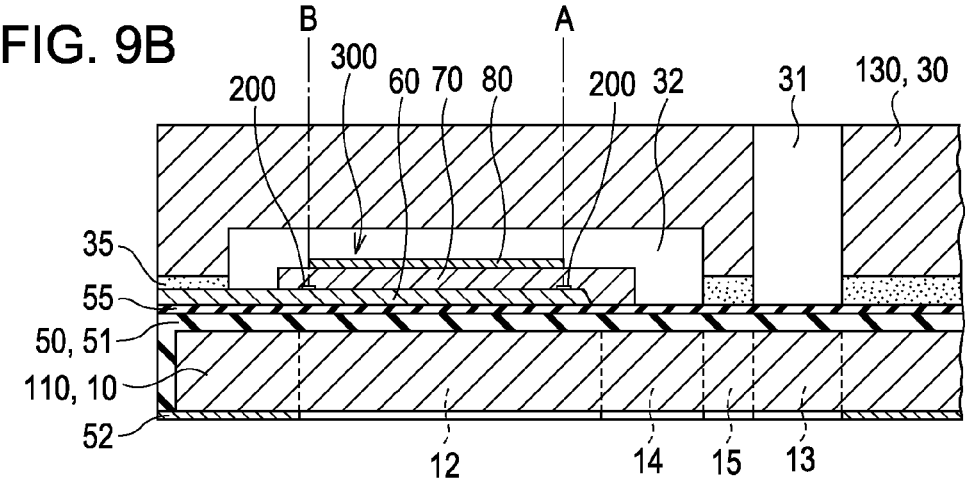
Figure 9C:
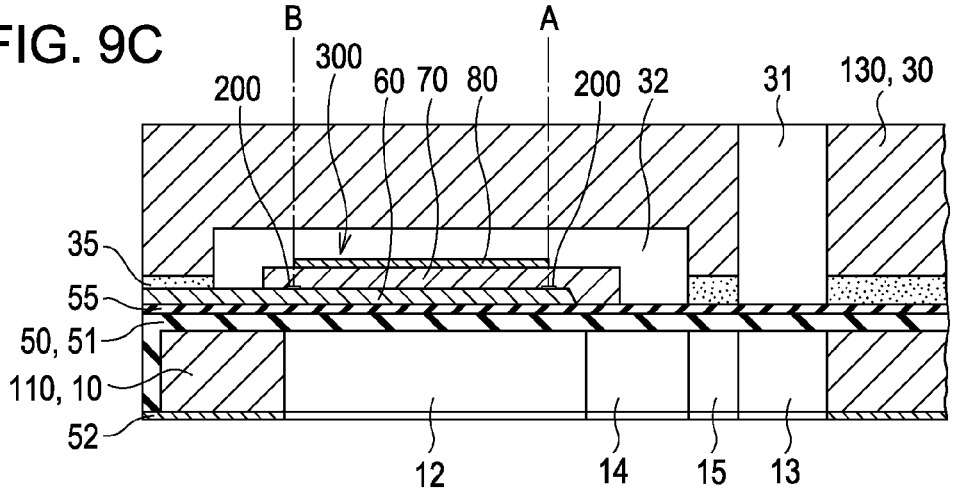

Subsequently, as shown in FIG. 9B, a mask film 52 formed, for example, of silicon nitride (SiN) is newly formed on the flow-channel-containing substrate wafer 110, and patterned into a predetermined shape. Then, as shown in FIG. 9C, the flow-channel-containing substrate wafer 110 is subjected to anisotropic etching (wet etching) using alkaline solution such as KOH via the mask film 52, the pressure generating chamber 12, the communicating portion 13, the ink supply channel 14, and the communicating channel 15 corresponding to the each piezoelectric element 300 are formed.

Subsequently, an unnecessary portion around the outer peripheral edges of the flow-channel-containing substrate wafer 110 and the protection substrate wafer 130 is removed by cutting, for example, by dicing or the like. Then, the nozzle plate 20 formed with the nozzle opening 21 is bonded to the flow-channel-containing substrate wafer 110 on the side opposite from the protection substrate wafer 130, and the compliance substrate 40 is bonded to the protection substrate wafer 130, and then the flow-channel-containing substrate wafer 110 is divided into the flow-channel-containing substrates 10 having a chip size as shown in FIG. 1, an ink jet printhead according to this embodiment is obtained.

Second Embodiment

Figure 10:
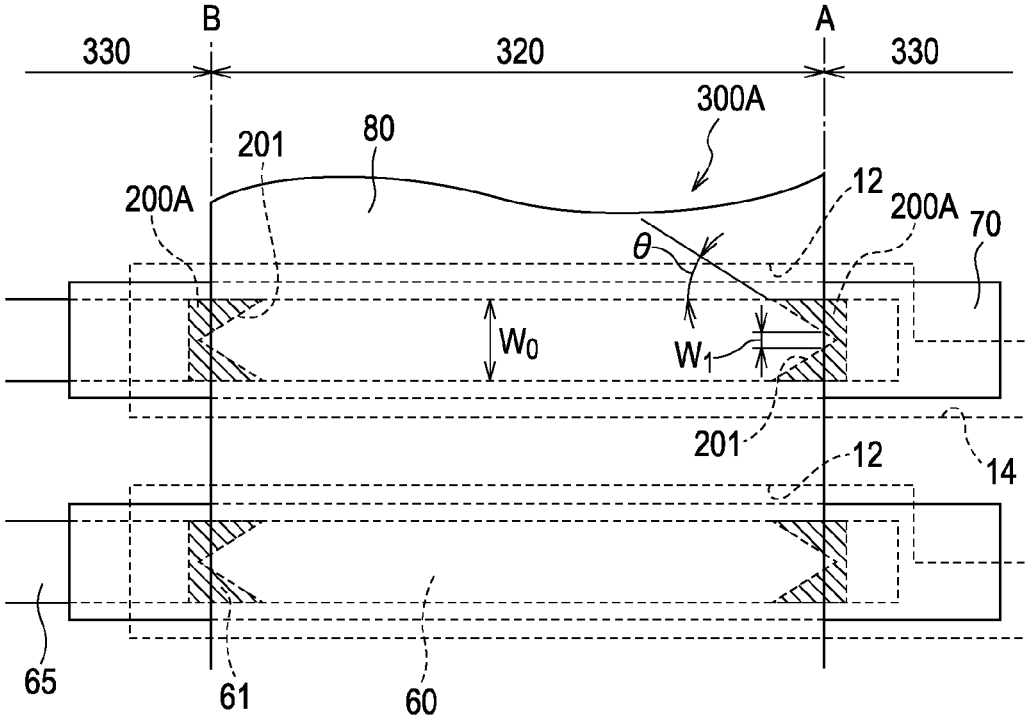
FIG. 10 is a plan view showing a printhead according to a second embodiment.

FIG. 10 is an enlarged plan view of an principal portion of an ink jet printhead as an example of the liquid ejection head according to a second embodiment of the invention. The like elements are designated by the same numerals as in the first embodiment and overlapped description will be omitted.

As shown in FIG. 10, a piezoelectric element 300A in the second embodiment includes the first electrode 60, a low dielectric material layer 200A, the piezoelectric layer 70, and the second electrode 80.

The low dielectric material layer 200A is disposed continuously across the boundary A between the active portion 320 and the non-active portion 330 at the boundary A between the active portion 320 and the non-active portion 330 on the side of the ink supply channel 14 in the longitudinal direction of the pressure generating chamber 12 (the direction intersecting the direction of arrangement of the pressure generating chambers 12).

The low dielectric material layer 200A is formed so that the width which covers the first electrode 60 is gradually increased from the active portion 320 side toward the boundary A. In other words, the low dielectric material layer 200A is formed so that the width which is overlapped with the first electrode 60 is increased in top view when viewing the first electrode 60 from the side of the second electrode 80 gradually from the active portion 320 toward the boundary A.

In this embodiment, the low dielectric material layer 200A is formed with a tapered portion 201, which is an opening cut out into a triangle shape which gradually exposes an end of the first electrode 60 on the boundary A side toward the boundary A on the side of the active portion 320. The tapered portion 201 of this embodiment is formed so as to extend continuously across the boundary A between the active portion 320 and the non-active portion 330, so that the width of the tapered portion 201, which covers the surface of the first electrode 60, is gradually increased across the active portion 320 and the non-active portion 330.

An angle θ of the insides surface of the tapered portion 201 is formed into an angle of 45° or smaller with respect to the side surface of the first electrode 60. In other words, an angle of an extremity of the tapered portion 201 on the side of the boundary A is 90° or smaller. By defining the angle of the tapered portion 201 in this manner, the rate of tapering of the surface area for applying a large electric field to the piezoelectric layer 70 toward the boundary between the active portion 320 and the non-active portion 330 can be set to a suitable value, so that the stress concentration at the boundary portion between the active portion 320 and the non-active portion 330 is reliably reduced and the probability of occurrence of the cracks due to the stress concentration is reduced.

A width $W_1$ of the boundary A of the tapered portion 201 which covers the first electrode 60 is preferably not more than 50% of a width $w_0$ of the first electrode 60, and suitably 25% to 50%. In this manner, by defining the width $W_1$ at the boundary A, the dispersion of the stress by the tapered portion 201 at the boundary is reliably achieved.

In this manner, since the low dielectric material layer 200A having the tapered portion 201 at the boundary A is provided on the piezoelectric element 300A in this embodiment, the surface area for applying a large electric field on the piezoelectric layer 70 in the active portion 320 is gradually reduced toward the boundary A. In other words, on the piezoelectric layer 70 in the active portion 320 on the non-active portion 330 side, an area in which the electric field is shielded by the low dielectric material layer 200A and hence a weak electric field is applied gradually increases toward the boundary A. Since the amount of displacement of the piezoelectric layer 70 varies corresponding to the surface area to which the electric field is applied as described above, the amount of displacement is gradually reduced toward the boundary A between the active portion 320 and the non-active portion 330 in the area where the tapered portion 201 is formed. Consequently, the angle of inclination of the boundary portion when the piezoelectric element 300 is displaced becomes less severe, so that the stress concentration at the boundary portion can be reduced. Therefore, the probability of occurrence of the destruction such as cracks at the boundary A of the piezoelectric layer 70 and in the vicinity thereof is reduced.

In this embodiment, as in the first embodiment described above, the low dielectric material layer 200A having the tapered portion 201 formed so that the width which covers the first electrode 60 is gradually increased from the active portion 320 toward the boundary B is also disposed at the boundary B between the active portion 320 and the non-active portion 330 on the opposite side from the ink supply channel 14. In this manner, by disposing the low dielectric material layer 200A having the tapered portion 201 also at the boundary B on the side of the extended portion 65 of the first electrode 60, the stress concentration at the boundary B between the active portion 320 and the non-active portion 330 on the side of the extended portion 65 is reduced, and the probability of occurrence of the destruction such as cracks is reduced.

Figure 11:
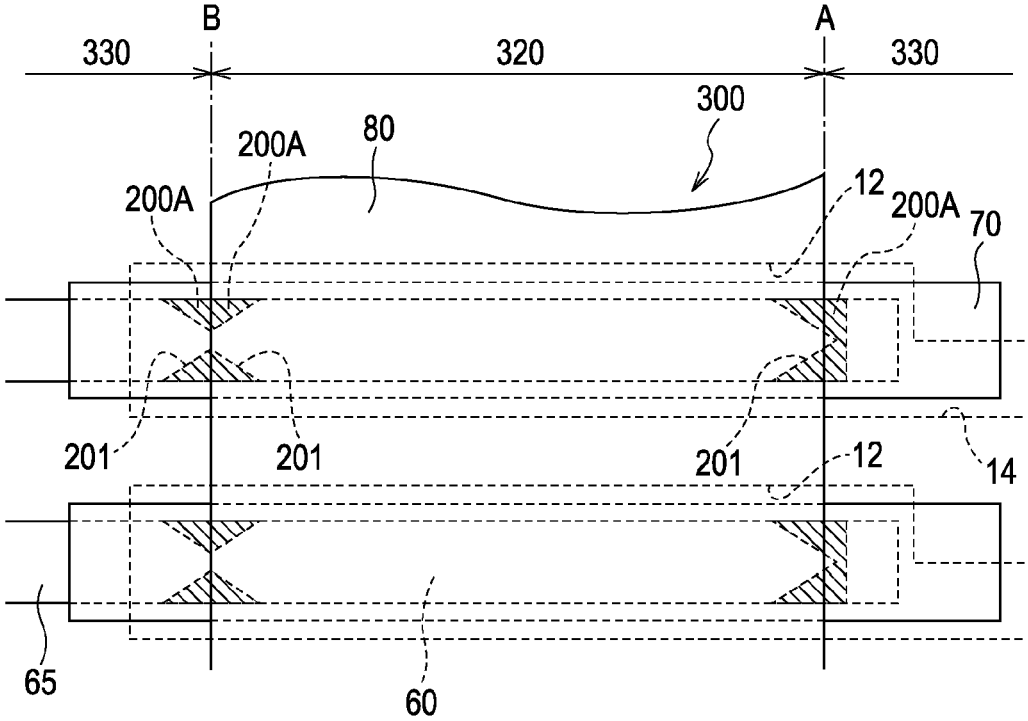
FIG. 11 is a plan view showing a modification of the printhead according to the second embodiment.

In this embodiment, the single low dielectric material layer 200A is provided on the side of the boundary B. However, the invention is not limited thereto. Another example is shown in FIG. 11. FIG. 11 is a plan view showing a modification of the ink jet printhead according to the second embodiment of the invention.

As shown in FIG. 11, one each of the low dielectric material layer 200A is provided both in the active portion 320 and in the non-active portion 330 on the side of the boundary B of the first electrode 60, and the low dielectric material layer 200A on the active portion 320 side and the low dielectric material layer 200A on the non-active portion 330 side are connected at the boundary B. The tapered portion 201 of the each low dielectric material layer 200A is configured to be opened continuously at the boundary B.

In this manner, with the provision of the two low dielectric material layers 200A at the boundary B and increasing the opening rate of the each tapered portion 201 toward the boundary B, the stress concentration at the boundary B can be alleviated.

In this embodiment, although the position of the low dielectric material layer 200A is not described, the low dielectric material layer 200A may be provided between the first electrode 60 and the piezoelectric layer 70, at the midsection of the piezoelectric layer 70 in the direction of the thickness, or between the piezoelectric layer 70 and the second electrode 80 in the same manner as the first embodiment described above. By forming the piezoelectric layer 70 by a thin film forming method with the existence of the piezoelectric layer 70 on the side of the second electrode 80 of the low dielectric material layer 200A, the crystallinity of the piezoelectric layer 70 on the low dielectric material layer 200A can be lowered and, in addition, the stress concentration at the boundaries A and B can be reduced.

Third Embodiment

Figure 12:
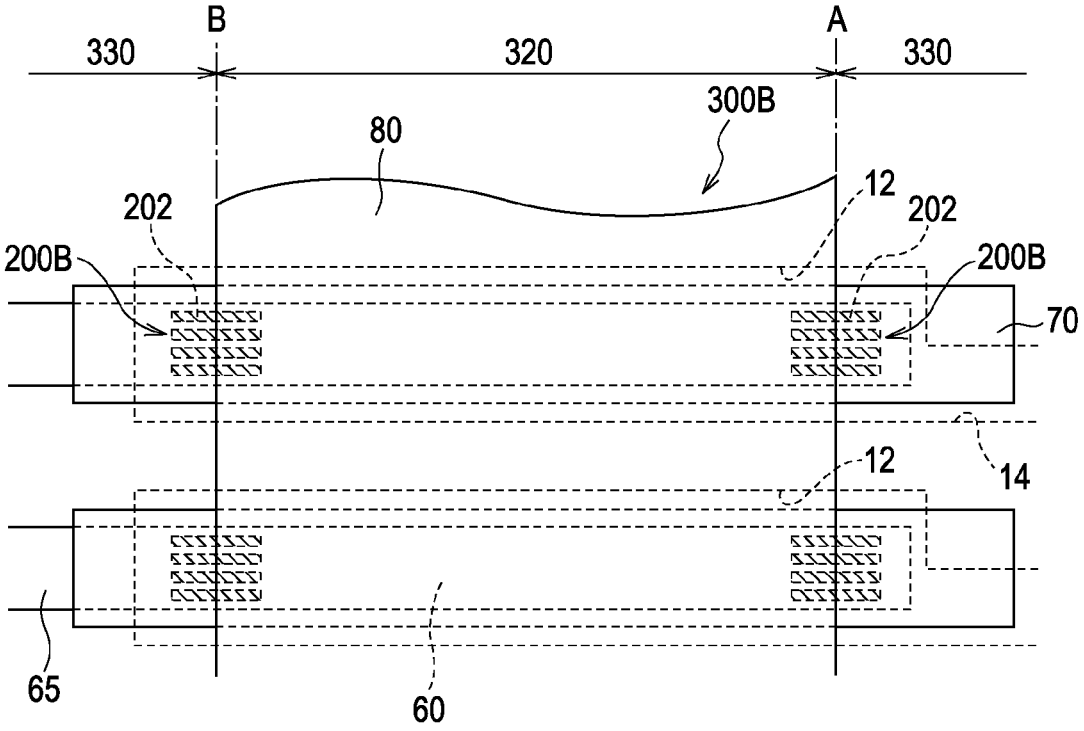
FIG. 12 is a plan view showing a printhead according to a third embodiment.

FIG. 12 is an enlarged plan view of an principal portion of an ink jet printhead as an example of the liquid ejection head according to a third embodiment of the invention. The like elements are designated by the same numerals as in the first embodiment and overlapped description will be omitted.

As shown in FIG. 12, a piezoelectric element 300B in the third embodiment includes the first electrode 60, a low dielectric material layer 200B, the piezoelectric layer 70, and the second electrode 80.

The low dielectric material layer 200B includes a plurality of long-strip-shaped first low dielectric portions 202 disposed continuously across the boundary A between the active portion 320 and the non-active portion 330 at the boundary A between the active portion 320 and the non-active portion 330 on the side of the ink supply channel 14 in the longitudinal direction of the pressure generating chamber 12 (the direction intersecting the direction of arrangement of the pressure generating chambers 12). The plurality of, in this embodiment, four first low dielectric portions 202 are arranged in the area opposing the first electrode 60 in the width direction of the first electrode 60 (in the direction of arrangement of the piezoelectric element 300).

With the low dielectric material layer 200B as described above, the stress concentration at the boundary A is reduced and the probability of occurrence of the destruction such as cracks in the piezoelectric layer 70 is reduced in the same manner as the first embodiment.

In this embodiment, as in the first embodiment described above, the low dielectric material layer 200B is also disposed at the boundary B between the active portion 320 and the non-active portion 330 on the opposite side from the ink supply channel 14. In this manner, by disposing the low dielectric material layer 200B also at the boundary B on the side of the extended portion 65 of the first electrode 60, the stress concentration at the boundary B between the active portion 320 and the non-active portion 330 on the side of the extended portion 65 is reduced, and the probability of occurrence of the destruction such as cracks is reduced.

In this embodiment, although the position of the low dielectric material layer 200B is not described, the low dielectric material layer 200B may be provided between the first electrode 60 and the piezoelectric layer 70, at the midsection of the piezoelectric layer 70 in the direction of the thickness, or between the piezoelectric layer 70 and the second electrode 80 in the same manner as the first embodiment described above. By forming the piezoelectric layer 70 by a thin film forming method with the existence of the piezoelectric layer 70 on the side of the second electrode 80 of the low dielectric material layer 200B, the crystallinity of the piezoelectric layer 70 on the low dielectric material layer 200B can be lowered and, in addition, the stress concentration at the boundaries A and B can be reduced.

Fourth Embodiment

Figure 13A:
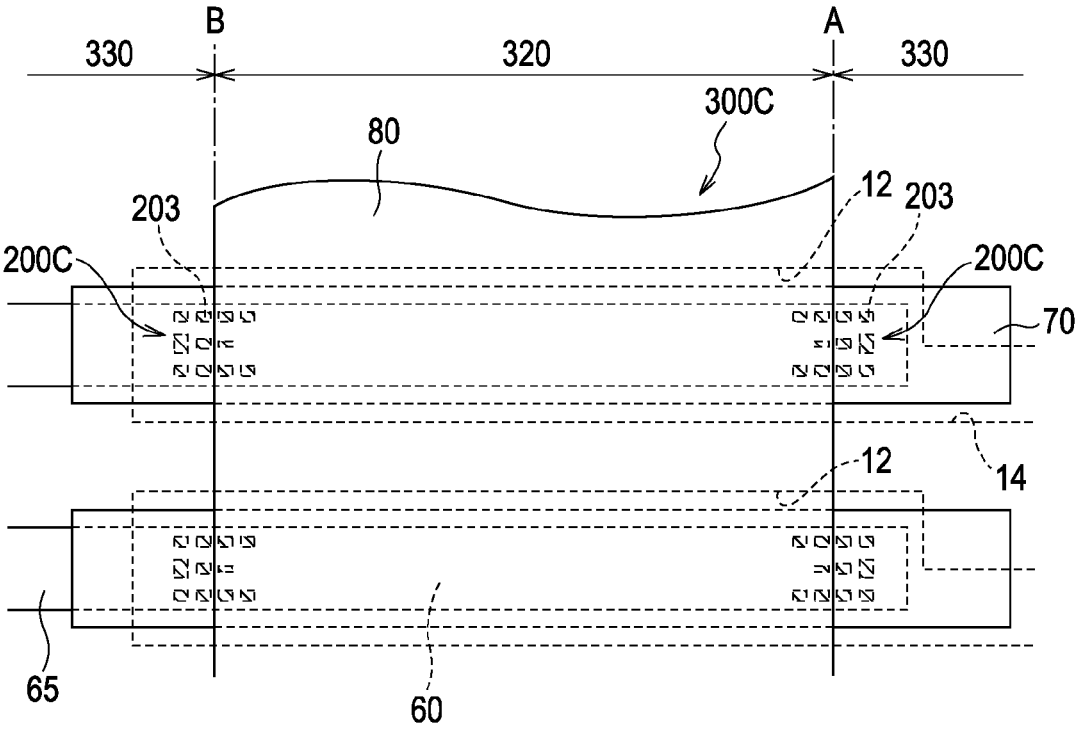
FIGS. 13A and 13B are plan views showing a printhead according to a fourth embodiment.
Figure 13B:
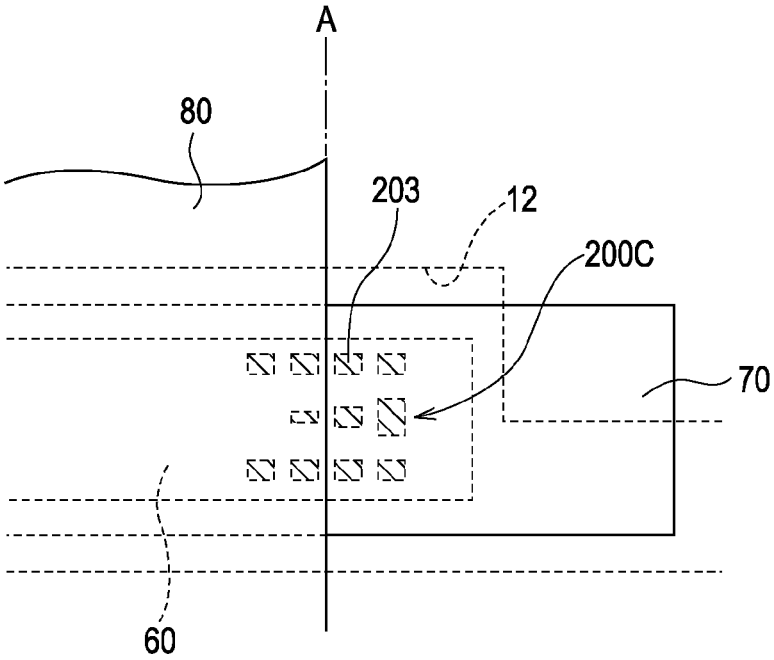

FIGS. 13A and 13B are enlarged plan views of an principal portion of an ink jet printhead as an example of the liquid ejection head according to a fourth embodiment of the invention. The like elements are designated by the same numerals as in the embodiments described above and overlapped description will be omitted.

As shown in FIG. 13A, a piezoelectric element 300C in the third embodiment includes the first electrode 60, a low dielectric material layer 200C, the piezoelectric layer 70, and the second electrode 80.

The low dielectric material layer 200C includes a plurality of second dielectric portions 203 disposed discontinuously across the boundary A between the active portion 320 and the non-active portion 330 at the boundary A between the active portion 320 and the non-active portion 330 on the side of the ink supply channel 14 in the longitudinal direction of the pressure generating chamber 12 (the direction intersecting the direction of arrangement of the pressure generating chambers 12). Three rows, each having a plurality of second dielectric portions 203 along the longitudinal direction of the first electrode 60 (in the direction intersecting the direction of arrangement of the piezoelectric element 300), are arranged in the direction of the width of the first electrode 60 in the area opposing the first electrode 60.

In this embodiment, the second dielectric portions 203 are formed into a rectangular shape, and each second dielectric portion 203 is not provided continuously across the active portion 320 and the non-active portion 330. However, since the plurality of second dielectric portions 203 are provided on both sides of the boundary A (the active portion 320 and the non-active portion 330), the low dielectric material layer 200C including a plurality of the second dielectric portions 203 is disposed across the active portion 320 and the non-active portion 330.

The low dielectric material layer 200C is formed so that the width which covers the first electrode 60 is gradually increased from the active portion 320 toward the non-active portion 330. In this embodiment, three rows of the second dielectric portions 203 arranged from the active portion 320 toward the non-active portion 330 are provided as described above as the low dielectric material layer 200C. In the middle row from these three rows, the surface area of the second dielectric portion 203 on the center side of the active portion 320 is reduced, and the surface area of the second dielectric portion 203 on the side of the non-active portion 330 is increased. The second dielectric portions 203 arranged in other two rows have the same opening surface area. Accordingly, the surface area of the low dielectric material layer 200C covering the first electrode 60 is gradually increased from the active portion 320 toward the non-active portion 330. Consequently, the angle of inclination of the boundary portion when the piezoelectric element 300 is displaced becomes less severe, so that the stress concentration at the boundary portion can be reduced. Therefore, the probability of occurrence of the destruction such as cracks at the boundary A of the piezoelectric layer 70 and in the vicinity thereof is reduced.

In this embodiment, as in the first embodiment described above, the low dielectric material layer 200C having the second dielectric portions 203 formed so that the width which covers the first electrode 60 is increased from the active portion 320 toward the boundary B is also disposed at the boundary B between the active portion 320 and the non-active portion 330 on the opposite side from the ink supply channel 14. In this manner, by disposing the low dielectric material layer 200C also at the boundary B on the side of the extended portion 65 of the first electrode 60, the stress concentration at the boundary B between the active portion 320 and the non-active portion 330 on the side of the extended portion 65 is reduced, and the probability of occurrence of the destruction such as cracks is reduced.

In this embodiment as well as a matter of course, the low dielectric material layer 200C may be disposed in the active portion 320 and the non-active portion 330 on both sides of the boundary B as in the example shown in FIG. 11 in the second embodiment described above.

In this embodiment, although the position of the low dielectric material layer 200C is not described, the low dielectric material layer 200C may be provided between the first electrode 60 and the piezoelectric layer 70, at the midsection of the piezoelectric layer 70 in the direction of the thickness, or between the piezoelectric layer 70 and the second electrode 80 in the same manner as the first embodiment described above. By forming the piezoelectric layer 70 by a thin film forming method with the existence of the piezoelectric layer 70 on the side of the second electrode 80 of the low dielectric material layer 200C, the crystallinity of the piezoelectric layer 70 on the low dielectric material layer 200C can be lowered and, in addition, the stress concentration at the boundaries A and B can be reduced.

Other Embodiments

Although the embodiments of the invention have been descried thus far, the basic configuration of the invention is not limited to the configurations described above. For example, in the first to fourth embodiments described above, the low dielectric material layers 200 to 200C are also disposed at the end of the active portion 320 on the opposite side from the ink supply channel 14 (the boundary B). However, the low dielectric material layers 200 to 200C on the side of the extended portion 65 may be combined in different ways from the low dielectric material layers 200 to 200C on the opposite side therefrom, that is, on the side of the ink supply channel 14.

Figure 14A:
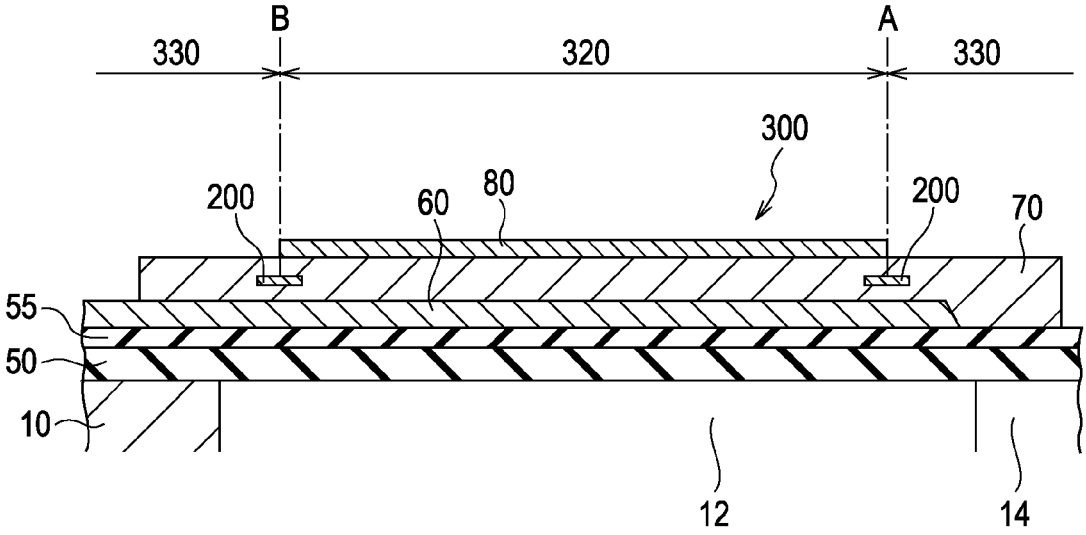
FIGS. 14A and 14B are cross-sectional views of a printhead according to another embodiment.
Figure 14B:
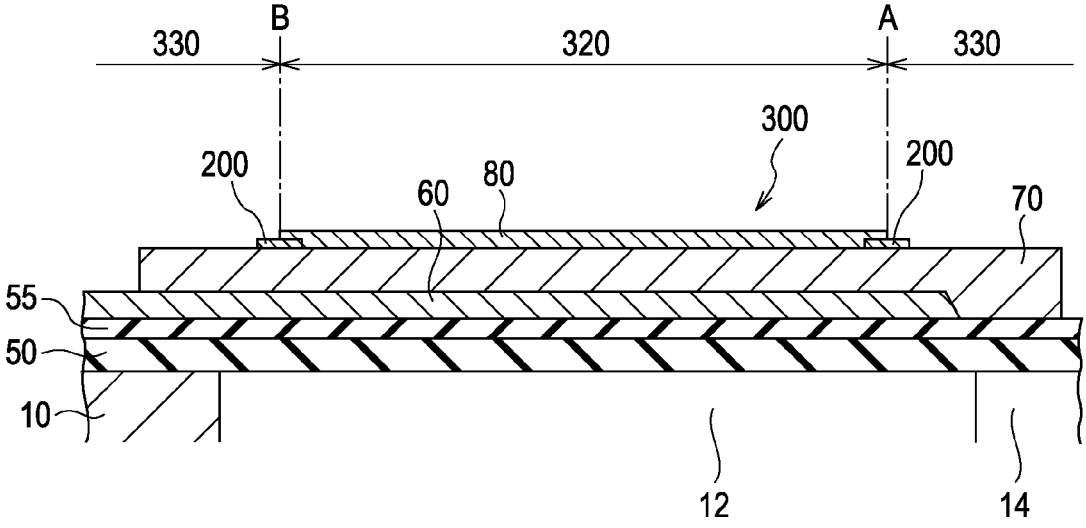

In the example described above, the low dielectric material layers 200 to 200C are disposed immediately on the first electrode 60. However, as described above, the positions of the low dielectric material layers 200 to 200C are not limited thereto. An example in which the positions of the low dielectric material layers 200 to 200C are changed is shown in FIGS. 14A and 14B. FIGS. 14A and 14B are cross-sectional views showing a modification according to other embodiments. As shown in FIG. 14A, the low dielectric material layer 200 may be provided at the midsection of the piezoelectric layer 70 in the direction of thickness. As shown in FIG. 14B, the low dielectric material layer 200 may be provided between the piezoelectric layer 70 and the second electrode 80.

In addition, in the example described above, the silicon monocrystalline substrate is exemplified as the flow-channel-containing substrate 10. However, the invention is not specifically limited thereto and, for example, materials such as SOI substrate or glass may be used.

In the examples described above, even when the protection films having moisture resistance are not provided on the piezoelectric elements 300 to 300C, since one end portion of the first electrode 60 in the longitudinal direction of the pressure generating chamber 12 is covered with the piezoelectric layer 70, current leak does not occur between the first electrode 60 and the second electrode 80, so that the destruction of the piezoelectric elements 300 to 300C can be restrained. Although the other end portion of the first electrode 60 in the longitudinal direction of the pressure generating chamber 12 is not covered with the piezoelectric layer 70, it has no specific effect because the first electrode 60 and the second electrode 80 are disposed at a distance from each other. The piezoelectric elements 300 to 300C in the examples shown above can be protected further reliably by providing a protective film having resistance to moisture. However, by not providing the protective film like the piezoelectric elements 300 to 300C in the example shown above, the protective film does not hinder the displacement of the piezoelectric elements 300 to 300C, and hence a larger amount of displacement can be obtained.

In the examples shown above, the piezoelectric layer 70 is cut into pieces for the respective pressure generating chambers 12. However, the invention is not limited thereto and, for example, the piezoelectric layer 70 which continues across the direction of arrangement of the pressure generating chambers 12 may be provided. In this case, for example, the low dielectric material layers 200 to 200C may be provided continuously across the direction of arrangement of the piezoelectric elements 300 to 300C.

Figure 15:
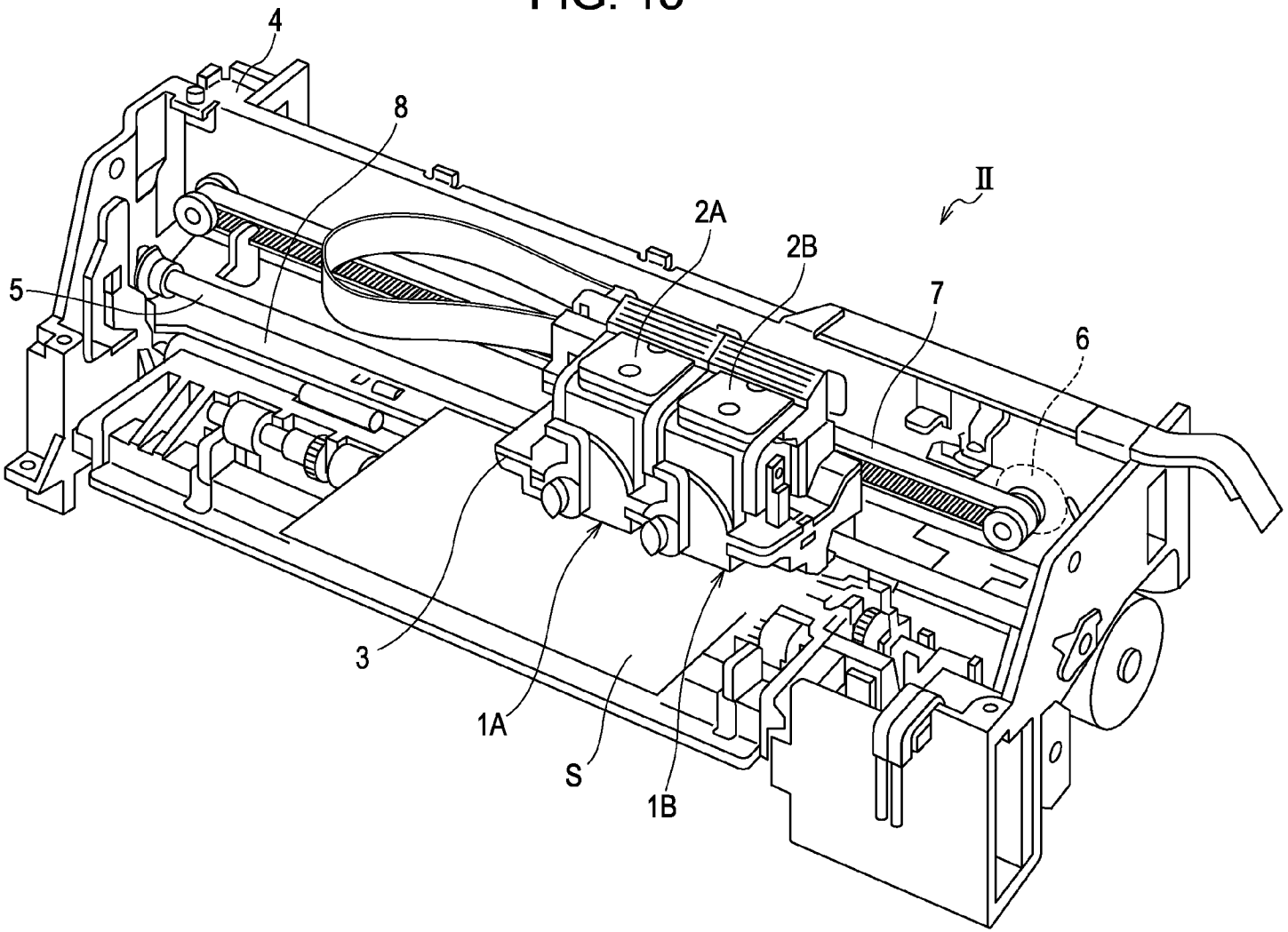
FIG. 15 is a general view of a printing apparatus according to an embodiment.

The ink jet printheads in the respective embodiments described above constitute part of a printhead unit having ink flow channels which are in communication with ink cartridges or the like and are mounted on an ink jet printing apparatus. FIG. 15 is a schematic drawing showing an example of the ink jet printing apparatus.

In an ink jet printing apparatus II shown in FIG. 15, print head units 1A and 1B having an ink jet printhead I includes cartridges 2A and 2B which constitute ink supply units demountably mounted thereon, and a carriage 3 having the print head units 1A and 1B mounted thereon is provided on a carriage shaft 5 attached to an apparatus body 4 so as to be movable in the axial direction. The print head units 1A and 1B are, for example, adapted to discharge black ink composition and color ink composition, respectively.

Then, by a drive force from a drive motor 6 transmitted to the carriage 3 via a plurality of gears and a timing belt 7, not shown, the carriage 3 having the printhead units 1A and 1B mounted thereon is moved along the carriage shaft 5. In contrast, a platen 8 is provided on the apparatus body 4 along the carriage shaft 5, and a printing sheet S as a printing medium such as paper supplied by a paper feed roller or the like, not shown, is wound around the platen 8 and is transported.

As the ink jet printing apparatus II described above, the one in which the ink jet printhead I (head units 1A and 1B) is mounted on the carriage 3 and moves in the primary scanning direction is exemplified. However, the invention is not limited thereto and, for example, the invention may also be applied to a so-called line type printing apparatus in which the ink jet printhead I is fixed and performs the printing job only by moving the printing sheet S such as paper in the secondary scanning direction.

In the example described above, the ink jet printhead has been described as an example of the liquid ejection head. However, the invention is intended to widely include general liquid ejection head, and can be applied to the liquid ejection head which ejects liquid other than ink, as a matter of course. As other types of liquid ejection heads, for example, the invention can be applied to a variety of printheads used for an image printing apparatus such as printers, coloring material ejection head used for manufacturing color filters such as liquid crystal displays, electrode material ejection head used for forming electrodes for displays such as organic EL displays or FED (field emission displays), and also biological organic substance ejection heads used for manufacturing biological chips.

What is claimed is:

1. A liquid ejection head comprising:

a flow-channel-containing substrate comprising pressure generating chambers communicating with a nozzle opening; and a piezoelectric element comprising a first electrode, a piezoelectric layer disposed above the first electrode, and a second electrode disposed above the piezoelectric layer, wherein the piezoelectric layer comprises:

an active portion which is substantially driven, comprising a laterally central portion and a lateral edge;

a non-active portion which is not substantially driven, wherein a boundary is defined between the edge of the active portion and the non-active portion; and a low dielectric material layer which has a dielectric constant lower than that of the central portion of the active portion and which is disposed at the active portion side of the boundary between the active portion and the non-active portion at the edge of the active portion, wherein no low dielectric material layer is provided at the central portion of the active portion.

2. The liquid ejection head according to claim 1, wherein the low dielectric material layer covers the surface of the first electrode and is configured so that the width gradually increases from the side of the active portion toward the boundary.

3. The liquid ejection head according to claim 1, wherein the low dielectric material layer is disposed across the boundary between the active portion and the non-active portion.

4. The liquid ejection head according to claim 3, wherein the low dielectric material layer is configured so that a width of the low dielectric material layer covering the surface of the first electrode increases from the active portion to the non-active portion.

5. The liquid ejection head according to claim 2, wherein the low dielectric material layer comprises a tapered portion which covers the surface of the first electrode so that the width of an exposed surface of the first electrode gradually reduces toward the boundary, and a side surface of the tapered portion is provided at an angle of 45° or smaller with respect to a side surface the first electrode.

6. The liquid ejection head according to claim 1, wherein the low dielectric material layer has a crystalline structure different from that of the central portion of the active portion.

7. The liquid ejection head according to claim 1, wherein the low dielectric material layer is provided on the first electrode.

8. The liquid ejection head according to claim 1, further comprising an extended portion extending to the outside of the piezoelectric layer provided on one end side of the first electrode in a direction intersecting a direction of arrangement of the pressure generating chambers, and the low dielectric material layer is provided at least at a portion opposite to the extended portion with respect to the boundary between the active portion and the non-active portion of the piezoelectric layer.

9. The liquid ejection head according to claim 8, wherein the low dielectric material layer is also provided at the side of the extended portion with respect to the boundary between the active portion and the non-active portion of the piezoelectric layer.

10. The liquid ejection head according to claim 9, wherein the low dielectric material layer in the area of the active portion is symmetrical with respect to the boundary.

11. A liquid ejection apparatus comprising a liquid ejection head according to claim 1.

* * * * *